US006250244B1

(12) United States Patent
Dubar et al.

(10) Patent No.: US 6,250,244 B1
(45) Date of Patent: Jun. 26, 2001

(54) LIQUEFACTION APPARATUS

(75) Inventors: Christopher A. T. Dubar, Beaumaris; Oliver Leh Ming Tu, North Balwyn, both of (AU)

(73) Assignee: BHP Petroleum PTY LTD, Melbourne (AU)

( * ) Notice: Subject to any disclaimer, the term of this patent is extended or adjusted under 35 U.S.C. 154(b) by 0 days.

(21) Appl. No.: 09/644,233

(22) Filed: Aug. 23, 2000

Related U.S. Application Data

(63) Continuation of application No. 09/051,210, filed as application No. PCT/GB96/02434 on Oct. 4, 1996, now abandoned.

(30) Foreign Application Priority Data

| | | |
|---|---|---|
| Oct. 5, 1995 | (GB) | 9520303 |
| Oct. 5, 1995 | (GB) | 9520348 |
| Oct. 5, 1995 | (GB) | 9520349 |
| Oct. 5, 1995 | (GB) | 9520356 |

(51) Int. Cl.[7] ..... B63B 35/44
(52) U.S. Cl. ..... 114/264; 62/613
(58) Field of Search ..... 114/65 R, 72, 114/73, 74 R, 74 T, 74 A, 256, 264, 270; 62/45.1, 48.1, 53.2, 6.3

(56) References Cited

U.S. PATENT DOCUMENTS

| | | | | |
|---|---|---|---|---|
| 3,677,019 | * | 7/1972 | Olszewski | 62/613 |
| 3,763,658 | * | 10/1973 | Gaumer, Jr. et al. | 62/612 |
| 3,766,583 | * | 10/1973 | Phelps | 114/264 |
| 4,217,848 | * | 8/1980 | Meyer-Haake | 114/264 |
| 4,586,942 | * | 5/1986 | Gauthier | 62/611 |
| 4,638,639 | * | 1/1987 | Marshall et al. | 62/613 |
| 4,846,862 | * | 7/1989 | Cook | 62/48.2 |

FOREIGN PATENT DOCUMENTS

3200958 * 7/1983 (DE) .

* cited by examiner

*Primary Examiner*—Stephen Avila
(74) *Attorney, Agent, or Firm*—Dykema Gossett PLLC

(57) ABSTRACT

A support structure that is either floatable or otherwise adapted to be disposed in an offshore location at least partially above sea level. A natural gas liquefaction system is located on or in the support structure and has a series of heat exchangers for cooling the natural gas in a countercurrent heat exchange relationship with a refrigerant. One or more compressors compress the refrigerant which is divided into two separate streams. Each stream is fed to a liquid expansion turbine where it is isentropically expanded. The expanded streams of refrigerant are then fed to the cool end of one of the heat exchangers.

23 Claims, 13 Drawing Sheets

B
A
REGION 1
REGION 2
REGION 3
REGION 4
REGION 5
TEMPERATURE ( C)
40
20
0
-20
-40
-60
-80
-100
-120
-140
-160
0
2
4
6
8
10
12
14
ENTHALPY CHANGE (Q)

101
102
166
132
159
171
172
173
169
170
141
140
139
120
165
164
150
133
110
103
131
121
122
136
138
123
162
155
151
134
160
142
129
124
128
137
127
109
153
161
163
106
156
G
126
135
157
168
154
108
107
167
111
112
158

LIQUEFACTION APPARATUS

CROSS-REFERENCES TO RELATED APPLICATIONS

This application is a continuation application of parent application Ser. No. 09/051,210, filed Jul. 13, 1998 which was derived from PCT International application no. PCT/GB96/02434, filed Oct. 4, 1996.

BACKGROUND OF THE INVENTION

1. Field of the Invention

This invention relates to a liquefaction apparatus, and more particularly relates to an offshore apparatus for liquefying natural gas.

2. Description of the Related Art

Natural gas is obtained from gas, gas/condensate and oil fields occurring in nature, and generally comprises a mixture of compounds, the most predominant of which is methane. Usually, natural gas contains at least 95% methane and other low boiling hydrocarbon (although it may contain less); the remainder of the composition comprises mainly nitrogen and carbon dioxide. The precise composition varies widely, and may include a variety of other impurities including hydrogen sulphide and mercury.

Natural gas may be "lean" gas or "rich" gas. These terms do not have a precise meaning, but it is generally understood in the art that a lean gas will tend to have less higher hydrocarbons than a rich gas. Thus, a lean gas may contain little or no propane, butane or pentane, whereas a rich gas would contain at least one of these materials.

Since natural gas is a mixture of gases, it liquifies over a range of temperatures; when liquefied, natural gas is called "LNG" (liquefied natural gas). Typically, natural gas compositions will liquefy, at atmospheric pressure, in the temperature range −165° C. to −155° C. The critical temperature of natural gas is about −90° C. to −80° C., which means that in practice it cannot be liquefied purely by the application of pressure it must be also be cooled below the critical temperature.

Natural gas is often liquefied before being transported to its point of end use. Liquefaction enables the volume of natural gas to be reduced by a factor of about 600. The capital costs, and running costs, of the apparatus required to liquefy the natural gas is very high, but not as high as the cost of transporting unliquefied natural gas.

The liquefaction of natural gas can be carried out by cooling the gas in countercurrent heat exchange relationship with a gaseous refrigerant, rather than with the liquid refrigerants used in conventional liquefaction methods, such as the cascade or propane-precooled mixed refrigerant processes. At least part of the refrigerant is passed through a refrigeration cycle which involves at least one compression step and at least one expansion step. Before the compression step, the refrigerant is usually at ambient temperature (ie the temperature of the surrounding atmosphere). During the compression step, the refrigerant is compressed to a high pressure, and is warmed by the compression process. The compressed refrigerant is then cooled with the ambient air, or with water if there is a water supply available, to return the refrigerant back to ambient temperature. The refrigerant is then expanded in order to cool it further. There are basically two methods of achieving the expansion. One method involves a throttling process, which may take place through a J-T valve (Joule-Thomson valve), wherein the refrigerant is expanded substantially isenthalpically. The other method involves a substantially isentropic expansion, which may take place through a nozzle, or, more usually, through an expander or turbine. The substantially isentropic expansion of the refrigerant is known in the art as "work expansion". When the refrigerant is expanded through a turbine, work may be recovered from the turbine: this work can be used to contribute to the energy required to compress the refrigerant.

It is generally recognised that work expansion is more efficient than throttling (a greater temperature drop can be achieved for the same pressure reduction), but the equipment is more expensive. As a result most processes usually use only work expansion, or a mixture of work expansion and throttling.

When natural gas of a particular composition is cooled at a constant pressure, then for any given temperature of the gas there will be a particular value for the rate of change of enthalpy (Q) of the gas. The temperature (T) can be plotted against Q to produce a "cooling curve" for natural gas. The cooling curve is highly dependent upon pressure: if the pressure is below the critical pressure, then the T/Q cooling curve is highly irregular, ie, it contains several portions of different gradient, including a portion of zero, or close to zero, gradient. With increases in pressure, particularly above the critical pressure, the T/Q cooling curve tends towards a straight line.

Reference is now made to FIG. 1, which is a graph of temperature vs. rate of change of enthalpy for the cooling of natural gas below and above critical pressure. The curve A, which is for the cooling of natural gas below critical pressure, will be considered in more detail. The curve A has a characteristic shape, which can be divided into a number of regions. Region 1 has a constant gradient and represents the sensible cooling of the gas. Region 2 has a decreasing gradient and is below the dew point temperature of the gas as heavier components begin to condense. Region 3 corresponds to the bulk liquefaction of the gas and has the lowest gradient in the curve: the curve in this portion is almost horizontal. Region 4 has an increasing gradient and is above the bubble point temperature of the liquid as the lightest components are condensed. Region 5 is below the bubble point temperature and is of a constant gradient, which is greater than the gradient of regions 3 and 4. Region 5 corresponds to the sensible cooling of the liquid; this is known as the "sub-cooling" region.

Reference is now made to FIG. 2 of the drawings, which is a graph of T/Q showing the combined cooling curve for natural gas and nitrogen, for a natural gas pressure of about 5.5 MPa. The graph also shows the warming curve for nitrogen over the same temperature range. This graph is representative of a liquefaction system in which natural gas is cooled in a series of heat exchangers by a simple nitrogen expander cycle. The nitrogen refrigerant exiting the series of heat exchangers is compressed, cooled with ambient air, cooled to about −152° C. by work expansion, then fed to the cold end of the series of heat exchangers. The nitrogen refrigerant is precooled, before work expansion, by being passed through at least one heat exchanger at the warm end of the series of heat exchangers; thus, the cooling curve is a combined natural gas/nitrogen cooling curve.

The gradient of the cooling and warming curves at any particular point in FIG. 2 is dT/dQ. It is well known in the liquefaction field that the most efficient process is one which, for any given value of Q, the corresponding temperature on the cooling curve of the natural gas is as close as possible to the corresponding temperature on the warming curve of the refrigerant. This has the implication that dT/dQ for the cooling curve of the natural gas is as close as possible to dT/dQ for the warming curve of the refrigerant. However, for any given Q, the closer the temperature of the natural gas and the refrigerant, the higher the surface area needed for the heat exchanger. Thus, there has to be a certain trade off between minimising the temperature difference, and minimising the heat exchanger surface area. For this reason, it is generally preferred that for any given Q, the temperature of the natural gas is at least 2° C. higher than that of the refrigerant.

In FIG. 2, the nitrogen warming curve is approximately a single straight line (ie, it has constant gradient). This is representative of a single stage refrigeration cycle, wherein the all the refrigerant nitrogen is cooled by work expansion to a low temperature of about −160° C. to −140° C., and is then passed in countercurrent heat exchange relationship with the natural gas. It is clear that at most parts of the T/Q curve there is a large temperature difference between the natural gas and the nitrogen refrigerant, and this indicates that the heat exchange is highly inefficient.

It is also known that the gradient of the warming curve of the refrigerant can be altered by changing the flow rate of the refrigerant through the heat exchangers: specifically, the gradient can be increased by decreasing the refrigerant flow rate. In the system shown in FIG. 2 it is not possible to decrease the nitrogen flow rate, because the increase in gradient will cause the nitrogen warming curve to intersect with the natural gas cooling curve. An intersection of the two curves is indicative of a temperature "pinch" or "cross-over" in the heat exchanger between the nitrogen and the natural gas, and under this condition it is impossible for the process to work.

However, if the nitrogen flow is split into two streams it is possible to make the nitrogen warming curve change from a single straight line into two intersecting straight line portions of different gradient. An example of such a process is disclosed in U.S. Pat. No. 3,677,019. This specification discloses a process in which the compressed refrigerant is split into at least two portions, and each portion is cooled by work expansion. Each work expanded portion is fed to a separate heat exchanger for cooling the gas to be liquefied. This causes the refrigerant warming curve to comprise at least two straight line portions of different gradient. This aids in the matching of the warming and cooling curves and improves the efficiency of the process. This specification was published over twenty years ago, and the process disclosed therein is inefficient by modern standards.

In U.S. Pat. No. 4,638,639 there is disclosed a process for liquefying a permanent gas stream, which also involves splitting the refrigerant stream into at least two portions in order to match the cooling curve of the gas to be liquefied with the warming curve of the refrigerant. The outlet of all the expanders in this process is at a pressure above about 1 MPa. The specification suggests that such high pressures increase the specific heat of the refrigerant, thereby improving the efficiency of the refrigerant cycle. In order to realise an efficiency improvement it is necessary for the refrigerant to be at, or near, its saturation point at the outlet of one of the expanders, because the specific heat is higher near to saturation. If the refrigerant is at the saturation point, then under these conditions there will be some liquid in the refrigerant that is fed to the heat exchangers. This leads to additional expense, because either the heat exchanger needs to be modified in order to handle a two-phase refrigerant, or the refrigerant needs to be separated into liquid and gaseous phases before being fed to the heat exchanger.

U.S. Pat. No. 4,638,639 is primarily concerned with processes in which the refrigerant comprises a portion of the gas to be liquefied, ie the refrigerant is the same as the gas to be liquefied. The specification is particularly concerned with a system in which nitrogen is liquefied using a nitrogen refrigerant. The specification does not specifically disclose a process in which natural gas is cooled by nitrogen, nor would it be expected to be useful in such a process, because all modern large-scale processes for liquefying natural gas use a mixed refrigerant cooling cycle. Furthermore, in U.S. Pat. No. 4,638,639 the gas being liquefied is cooled to a temperature just below its critical temperature. A series of three J-T valves are provided to sub-cool the gas being liquefied.

The earliest refrigerant cycle used for the liquefaction of natural gas was the cascade process. Natural gas can be cooled in the cascade process by successive cooling with, for example, propane, ethylene and methane refrigerants. The mixed refrigerant cycle, which was developed later, involves the circulation of a multi component refrigerant stream, usually after precooling to −30° C. with propane. The nature of the mixed refrigerant cycle is such that the heat exchangers in the process must routinely handle the flow of a two phase refrigerant. This requires the use of large, specialised heat exchangers. The mixed refrigerant cycle is the most thermodynamically efficient of the previously known natural gas liquefaction processes: it enables the warming curve of the refrigerant to be closely matched to the cooling curve of the natural gas over a wide temperature range. Examples of mixed refrigerant processes are disclosed in U.S. Pat. Nos. 3,763,658 and 4,586,942, and in European Paten No 87,086.

One of the reasons for the widespread use of the mixed refrigerant cycle in the cooling of natural gas is the efficiency of that process. The installation of a typical mixed refrigerant liquefaction plant for natural gas would cost upward of $US 1,000,000,000, but the high cost can be justified by the efficiency gains. In order to be cost effective through economy of scale the mixed refrigerant plants typically need to be able to produce at least 3 million tonnes of LNG per annum.

The size and complexity of mixed refrigerants liquefaction plants is such that, to date, they have all been constructed, and located, on land. Due to the size of natural gas liquefaction plants, and the requirement for deep water harbours, they cannot always be located near to the natural gas fields. Gas from the natural gas fields is usually transported to the liquefaction plant by pipeline. In the case of offshore natural gas fields, there are severe practical limitations on the maximum length of the pipeline. This means that offshore natural gas fields that are more than about 200 miles from land are seldom developed.

BRIEF SUMMARY OF THE INVENTION

According to one aspect of the present invention there is provided an offshore apparatus for liquefying natural gas, comprising a support structure which is either floatable or is otherwise adapted to be disposed in an offshore location at least partially above sea level, and natural gas liquefaction means disposed on or in the support structure, the natural gas liquefaction means comprising a series of heat exchangers for cooling the natural gas in countercurrent heat exchange relationship with a refrigerant, compression means for compressing the refrigerant, and expansion means for isentropically expanding at least two separate streams of the compressed refrigerant, wherein said expanded streams of refrigerant communicate with a cool end of a respective one of the heat exchangers.

The support structure may be a fixed structure, ie a structure that is fixed to the seabed, and is supported by the seabed. Preferred forms of fixed structure include a steel jacket support structure and a gravity base support structure.

Alternatively, the support structure may be a floating structure, ie a structure that floats above the seabed. In this embodiment, the support structure is preferable a flatable vessel having a steel or concrete hull, such as a ship or a barge.

In one preferred embodiment, the support structure is a floating production storage and off-loading unit (FPSO).

Pretreatment means is usually provided for pretreating the natural gas before it is delivered to the liquefaction means. The pretreatment means may include separation stages for removing impurities, such as condensate, carbon dioxide and produced water.

The natural gas liquefaction apparatus may be provided in combination with storage means for receiving and storing the natural gas after it has been liquefied. The storage means may be provided on or in the support structure. Alternatively, the storage means may be provided on a separate support structure, which is either floatable or otherwise adapted to be disposed in an offshore location at least partially above sea level; the separate support structure may be of the same type as, or of a different type to, the support structure for the liquefaction means. It is particularly preferred that the support structure is a ship, and that the liquefaction means and the storage means are provided on said ship.

In a preferred embodiment, the support structure comprises two spaced gravity bases, and a platform bridging said gravity bases, wherein said storage means comprises a storage tank provided on or in at least one of said gravity bases, and wherein the liquefaction means is provided on or in said bridging platform.

Means can be provided for connecting said apparatus to a subsea well, whereby the natural gas can be delivered to the liquefaction means at a pressure above 5.5 MPa, said pressure being derived directly or indirectly from the pressure in the subsea well. To facilitate this, the apparatus according to the invention can be located sufficiently close to the natural gas producing formation that the pressure of the natural gas in the series of heat exchangers can be provided substantially entirely by the pressure inherent in the natural gas producing formation. In certain gas fields, some of the gas may be recompressed for re-injection, and therefore may be available at a high pressure if passed through one or more compression stages of the re-injection apparatus before being passed to the liquefaction means.

According to another aspect of the invention there is provided natural gas liquefaction apparatus, for offshore installation, comprising: natural gas liquefaction means having (i) a series of heat exchangers for cooling the natural gas in countercurrent heat exchange relationship with a refrigerant, (ii) compression means for compressing the refrigerant, and (iii) expansion means for isentropically expanding at least two separate streams of the compressed refrigerant, wherein said expanded streams of refrigerant communicate with a cool end of a respective one of the heat exchangers; and a support frame carrying the components of the liquefaction means as a single unit for transportation to, and installation at, the offshore location.

Preferably, the liquefaction means further comprises cooling means for cooling the refrigerant after it has been compressed and before it is isentropically expanded, said cooling means comprising a heat exchanger, a liquid coolant and a refrigeration unit for cooling the coolant to a temperature between −10° C. and 20° C., wherein the compressed refrigerant is cooled in said heat exchanger in countercurrent relationship with said coolant.

The expansion means may comprise a work expander disposed in each of said compressed refrigerant streams, and the compression means may comprise at least one compressor.

The compression means preferably comprises a first compressor adapted to compress the refrigerant to an intermediate pressure, and a second compressor adapted to compress the refrigerant to a higher pressure. The second compressor is desirably operatively connected to the refrigerant expander means, whereby substantially all the work required to compress the refrigerant from the intermediate pressure to the higher pressure is provided by the expansion means. In one construction the expansion means comprises two turbo expanders, and the second compressor comprises two compressors each operatively connected to a respective one of the turbo expanders. In another construction the refrigerant expander means comprises two turbo expanders, and the second compressor comprises a single compressor operatively connected to both the turbo expanders by means of a common shaft. An aftercooler is generally provided for cooling the compressed refrigerant from the second compression means.

The first compressor may comprise a single compressor with an aftercooler for cooling the compressed refrigerant, but it is preferred that the first compressor comprises a series of at least two compressors with an intercooler between each compressor of the series, and an aftercooler after the last compressor of the series.

The series of heat exchangers preferably comprises an initial heat exchanger, an intermediate heat exchanger and a final heat exchanger, and the natural gas is passed sequentially through the initial, the intermediate and the final heat exchangers in order to cool it to successively cooler temperatures; refrigerant in a first of said refrigerant streams is delivered to the final heat exchanger, and refrigerant in a second of said refrigerant streams is delivered to the intermediate heat exchanger.

The refrigerant may be cooled in the initial heat exchanger after being compressed, but before being isentropically expanded, and the refrigerant in said first refrigerant stream may be cooled in the intermediate heat exchanger after being cooled in the initial heat exchanger, but before being isentropically expanded.

The apparatus is preferably operated such that the final heat exchanger receives refrigerant from the first refrigerant stream, and the relative flowrates of the first and second refrigerant streams are such that the warming curve for the refrigerant comprises a plurality of segments of different gradient, the refrigerant is warmed in said final heat exchanger to a temperature below −80° C., and the coolest refrigerant temperature and the flowrate of refrigerant in said first refrigerant stream are such that a part of the refrigerant warming curve relating to the final heat exchanger is at all times within 1 to 10° C., preferably 1 to 5° C., of the corresponding part of the cooling curve for the natural gas.

It will usually be most efficient to operate the heat exchangers such that the temperature difference between the natural gas cooling curve and the corresponding part of the refrigerant warming curve is between 1° C. and 5° C. Typically this temperature difference will be above 2° C., because smaller temperature differences require larger, more expensive, heat exchangers, and there is a greater risk that a temperature pinch will be inadvertently created in the heat exchanger. However, in circumstances where there is a surplus of energy available, it can be sensible to operate with temperature differences above 5° C., and perhaps as high as 10° C.: this enables the size of the heat exchangers to be reduced, thereby saving capital costs.

The apparatus is preferably operated such that the coolest refrigerant temperature is no greater than −130° C., whereby the natural gas is sub-cooled substantially in said series of heat exchangers. Most preferably, the coolest refrigerant temperature is in the range −140° C. to −160° C.

The liquefaction means may further comprise a gas turbine for generating power for the compression means. The gas turbine preferably comprises an aero-derivative gas turbine; this is advantageous because it has a smaller size and weight than the alternative industrial type gas turbines commonly used in onshore LNG plants. In addition, the aero-derivative turbine has high thermal efficiency, and it is easy to maintain due to its light weight components. The number and rating of the turbines depends upon the amount of LNG that it is desired to produce; for example, to produce about 2 million tonnes LNG/annum would require two aero-derivative turbines each rated at about 40 MW.

It is preferred that the liquefaction means further comprises a second series (or "train") of heat exchangers, said second series of heat exchangers being arranged in parallel with said first series of heat exchangers, and a separate refrigerant compression means and refrigerant expansion means for each series of heat exchangers. At least some of the or each series of heat exchangers and pipework connected thereto are preferably disposed within a single, common heat insulating housing—this is known as a "cold box", and it usually contains pearlite or rock wool. When there is more than one heat exchanger train, it is preferred that each heat exchanger train is disposed in its own cold box.

The liquefaction means may further comprise natural gas expansion means adapted to receive and expand sub-cooled natural gas from the series of the heat exchangers; the expansion means serves to expand the sub-cooled natural gas to a sub-critical pressure, thereby simultaneously cooling and liquefying the natural gas. The expansion means may be substantially isenthalpic expansion means, such as a J-T valve, or substantially isentropic expansion means, such as a liquid or hydraulic turbine expander. When the expansion means comprises a liquid or hydraulic turbine expander, or other work-producing expansion means, it is preferred that an electrical generator is provided. The generator is arranged to convert the work produced by the expansion means into electrical energy.

The liquefaction means may further comprise a flash vessel adapted to receive expanded natural gas from the natural gas expansion means. In practice the expanded natural gas comprises a two phase mixture of liquid and gas. The flash vessel is provided with a fuel gas exit, through which natural gas comprising mainly methane and a lesser amount of nitrogen is taken, and a LNG exit through which LNG is taken. It is preferable that the flash vessel is provided in the form of a fractionating column having a reboiler which comprises a heat exchanger arranged to warm a liquid stream, taken from the column, in countercurrent heat exchange relationship with natural gas exiting said series of heat exchangers. A fuel gas compressor means can be provided to compress the fuel gas to a suitable pressure for use in a gas turbine, after the gas is warmed in a heat exchanger. The flash vessel is preferably disposed within the cold box. It is desirable that the gas turbine is powered by fuel gas derived from the fuel gas exit of the flash vessel: by means of this arrangement, all the work required to compress the refrigerant is provided to the first compressor means, and this work is entirely provided by fuel gas created by the liquefaction process.

There are a number of suitable embodiments for the heat exchangers in the series. Aluminum plate-fin heat exchangers can only be manufactured up to a certain size and a number of individual cores must be manifolded together in parallel to handle the flowrates involved in the process and apparatus of the present invention. The single phase nature of the refrigerant makes it possible for these cores to be manifolded together relatively easily, without the difficulties encountered with two phase systems. However, aluminium plate-fin heat exchangers are constrained by the fact that the allowable design pressure decreases with increasing core size: in order to maintain the number of cores to a practical limit, the natural gas pressure should be below about 5.5 MPa. If higher pressures are desired, then it is preferred to use a spiral wound heat exchanger, a PCHE (printed circuit heat exchanger) or spool wound heat exchanger. Each heat exchanger in the series may comprise a plurality of heat exchanger cores in parallel. Each heat exchanger in the series may comprise more than one heat exchanger. In the preferred arrangement, the heat exchangers in the series are integrated into a single unit with appropriate inlet and outlet conduits.

It is possible for the natural gas to be cooled by the refrigerant in further intermediate heat exchangers arranged upstream of the final heat exchanger. However, it is preferred to use only one intermediate heat exchanger, because this reduces the complexity of the equipment, and makes it possible to achieve lower pressure drops across the heat exchanger train.

Whilst it is preferred that the refrigerant is divided into two streams, because this is the arrangement uses the least space, it is possible to divide the refrigerant into three, four or more streams. Each stream may be isentropically expanded in parallel with the other streams. It is also possible for one or more of the isentropic expansion steps to be carried out in stages using a series of isentropic expanders.

It is preferred that the refrigerant comprises at least 50 mol % nitrogen, more preferably at least 80 mol % nitrogen, and most preferably substantially 100 mol % nitrogen. Nitrogen has a substantially linear warming curve over the temperature range −160° C. to 20° C. In one preferred embodiment the refrigerant comprises nitrogen and up to 10 vol %, preferably 5–10 vol %, methane.

The refrigerant is ideally provided in a closed loop refrigerant cycle. The refrigerant could be, but need not be, taken from the stream of natural gas to be liquefied. Make-up refrigerant can be provided from a refrigerant source external to the refrigerant cycle.

The apparatus according to the invention is preferably operated in accordance with a process described in our copending PCT application of even date entitled "Liquefaction Process". According to this process there is provided a natural gas liquefaction process comprising passing natural gas through a series of heat exchangers in countercurrent relationship with a gaseous refrigerant circulated through a work expansion cycle, said work expansion cycle comprising compressing the refrigerant, dividing and cooling the refrigerant to produce at least first and second cooled refrigerant streams, substantially isentropically expanding the first refrigerant stream to a coolest refrigerant temperature, substantially isentropically expanding the second refrigerant stream to an intermediate refrigerant temperature warmer than said coolest refrigerant temperature, and delivering the refrigerant in the first and second refrigerant streams to a respective heat exchanger for cooling the natural gas through corresponding temperature ranges, wherein the refrigerant in the first stream is isentropically expanded to a pressure at least 10 times greater than, and usually more than 10 times greater than, the total pressure drop of the first refrigerant stream across said series of heat exchangers, said pressure being in the range 1.2 to 2.5 MPa.

Preferably, the refrigerant is compressed to a pressure in the range 5.5 to 10 MPa. It is preferred that the first stream is isentropically expanded to a pressure in the range 1.5 to 2.5 MPa. The refrigerant in the first stream is preferably isentropically expanded to a pressure at least 20 times greater than the total pressure drop of the first refrigerant stream across said series of heat exchangers. It is possible to operate the process such that the first stream is isentropically expanded to a pressure at least 100 times greater than the total pressure drop of the first refrigerant stream across said series of heat exchangers. However, for most practical installations the refrigerant in the first stream will be isentropically expanded to a pressure not more than 50 times greater than the total pressure drop of the first refrigerant stream across said series of heat exchangers.

In one particularly desirable embodiment the refrigerant is compressed to a pressure in the range 7.5 to 9.0 MPa, the refrigerant in the first refrigerant stream is expanded to a pressure in the range 1.7 to 2.0 MPa, and the refrigerant in the first stream is isentropically expanded to a pressure in the range 15 to 20 times the total pressure drop of the first refrigerant stream across said series of heat exchangers.

The process is usually operated such that the temperature of each refrigerant stream after each isentropic expansion is greater than 1–2° C. above the saturation temperature of the refrigerant. Under these conditions, the refrigerant is well into the single phase, and is not close to saturation, there will be substantially no liquid in the isoentropically expanded refrigerant portions. However, there may be circumstances when it is desirable to operate the process such that a small amount of liquid is formed during expansion. For example, if the refrigerant comprises nitrogen with up to 10 vol % methane, preferably 5–10 vol % methane, then the process will be most efficient if some liquid is allowed to form during expansion.

The ratio of the pressure of the refrigerant, immediately prior to the isentropic expansion, to the pressure of the refrigerant, immediately after the isentropic expansion, is preferably in the range 3:1 to 6:1, more preferably 3:1 to 5:1.

In practice the best value for the intermediate refrigerant temperature depends upon the composition of the natural gas, and its pressure. However, in general the optimum value for the intermediate refrigerant temperature will be in the range −85° C. to −110° C.

The apparatus according to the invention can be used to produce LNG on a commercial scale, typically 0.5 to 2.5 million tonnes of LNG per annum. In an offshore natural gas liquefaction apparatus comprising two heat exchanger trains each in a cold box, it is possible to produce around 3 million tonnes/annum of LNG. The heat exchanger trains, including power generators and other associated equipment can be fitted on a single platform of about 35 m by 70 m, having a weight around 9000 tonnes. This size is small enough for the liquefaction means to be installed on an offshore production platform or a floating production and storage vessel.

The use of the present invention to liquefy gas at an offshore location has a number of advantages. The equipment is simple, particularly compared with the mixed refrigerant cycle; the refrigerant can be non-flammable; a relatively small amount of space is required; and the invention can be operated entirely with known, readily available equipment.

BRIEF DESCRIPTION OF THE DRAWINGS

Reference is now made to the accompanying drawings in which.

DETAILED DESCRIPTION OF THE INVENTION

Figure 1:
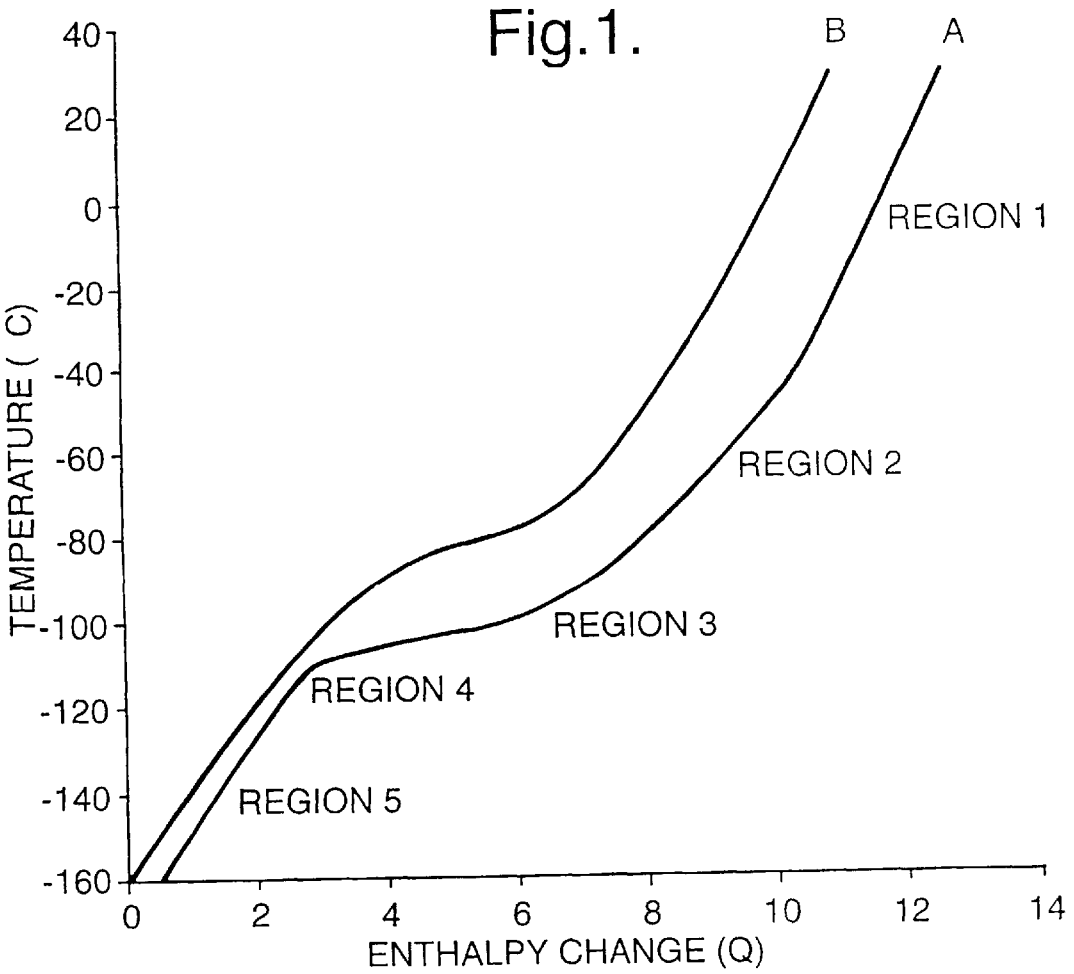
FIG. 1 is a graph of temperature vs. rate of change of enthalpy showing the cooling curve of natural gas above and below critical pressure.
Figure 2:
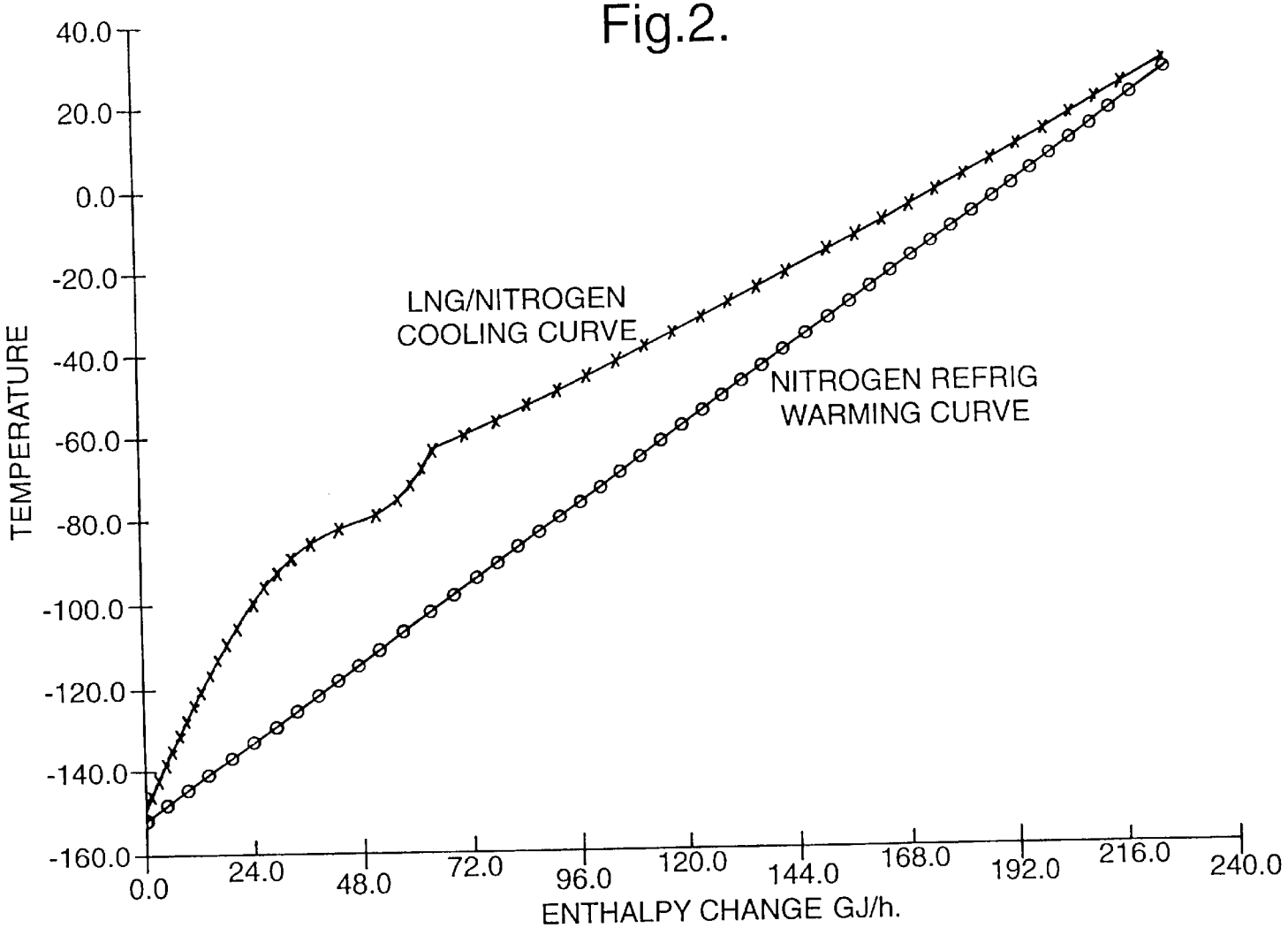
FIG. 2 is a graph of temperature vs. rate of change of enthalpy showing the combined cooling curve for natural gas and nitrogen, and the warming curve for nitrogen, in a simple expander process.
Figure 3:
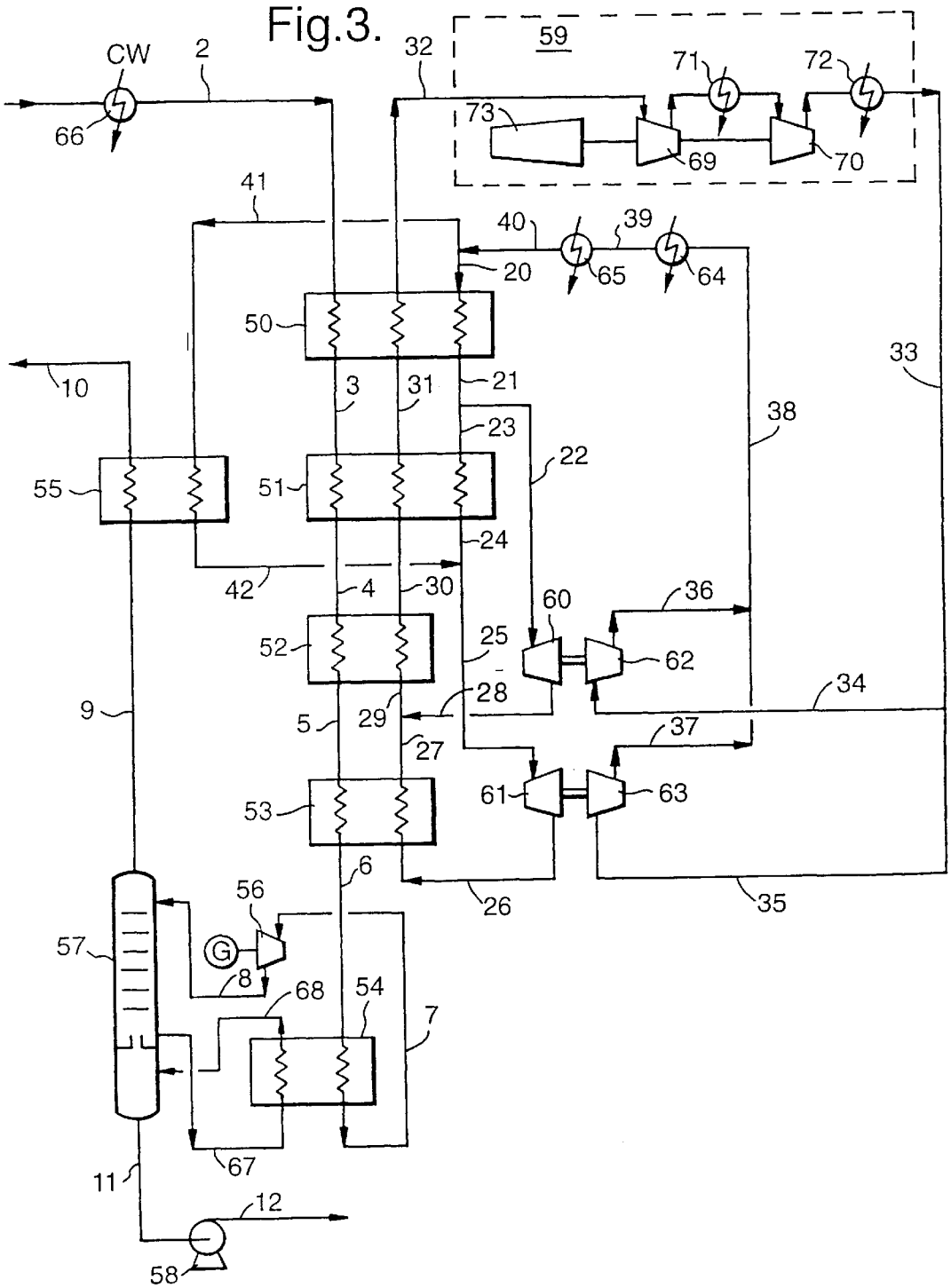
FIG. 3 is a schematic diagram showing one embodiment of apparatus for the process according to the present invention.

FIGS. 1 and 2 have already been discussed above. Referring to FIG. 3, an apparatus for liquefying natural gas is shown. Lean natural gas, at a pressure of about 5.5 MPa, is fed from a pre-treatment plant (not shown) to conduit 1. The natural gas is conduit 1 comprises 5.7 mol % nitrogen, 94.1 mol % methane and 0.2 mol % ethane. Various pre-treatment arrangements are known in the art and the exact configuration depends on the composition of the natural gas recovered from the ground, including the level of undesirable contaminants. Typically the pre-treatment plant would remove carbon dioxide, water, sulphur compounds, mercury contaminants and heavy hydrocarbons.

The natural gas in conduit 1 is fed to heat exchanger 66, where it is cooled to 10° C. with chilled water. The exchanger 66 could be provided as part of the pre-treatment plant. In particular, the exchanger could be provided upstream of a water removal unit of the pre-treatment plant, in order to allow condensation and separation of the water contained in the natural gas, and to minimise the size of equipment.

The natural gas exiting the heat exchanger 66 is fed to conduit 2 from where it is passed to the warm end of a series of heat exchangers comprising an initial heat exchanger 50, two intermediate heat exchangers 51 and 52, and a final heat exchanger 53. The series of heat exchangers 50 to 53 serves to cool the natural gas to a temperature sufficiently low that it can be liquefied when flashed to a pressure (usually about atmospheric pressure) below the critical pressure of the natural gas.

The natural gas in conduit 2, at a temperature of about 10° C., is first fed to the warm end of the heat exchanger 50. The natural gas is cooled in heat exchanger 50 to −23.9° C., and is passed from the cool end of the exchanger 50 to a conduit 3. The natural gas in conduit 3 is fed to the warm end of the exchanger 51, in which it is cooled to a temperature of −79.5° C. The natural gas exits the cool end of the exchanger 51 into a conduit 4, from which it is fed to the warm end of the exchanger 52. The exchanger 52 cools the natural gas to a temperature of −102° C., and natural gas exits the cool end of exchanger 52 into a conduit 5. The natural gas in conduit 5 is fed to the warm end of exchanger 53, in which it is cooled to a temperature of −146° C. The natural gas exits the cool end of the exchanger 53 into a conduit 6.

The natural gas in conduit 6 is fed to the warm end of a heat exchanger 54, in which it is cooled to a temperature of about −158° C., and it exits the cool end of the exchanger 54 into a conduit 7. The natural gas in conduit 7, which is still at supercritical pressure, is fed to a liquid expansion turbine 56 in which the natural gas is substantially isentropically expanded to a pressure of about 150 kPa. In the turbine 56 the natural gas is liquefied, and is reduced in temperature to about −166° C. The turbine 56 drives an electrical generator G to recover the work as electrical power.

The fluid exiting the turbine 56 is fed to a conduit 8. This fluid is predominantly liquid natural gas, with some natural gas in the gaseous state. The fluid in conduit 8 is fed to the top of a fractionating column 57. The natural gas feed in column 1 contains about 6 mol % of nitrogen: the fractionating column 57 serves to strip this nitrogen from the LNG. The stripping process is assisted by using the exchanger 54 to provide reboil heat transferred from the natural gas in conduit 6. LNG is fed from the column 57 to conduit 67, through which the LNG is fed to the cool end of the exchanger 54. The exchanger 54 warms the LNG to a temperature of about −160° C.; the LNG exits the warm end of the exchanger 54 into conduit 68, through which it is fed back to the column 57.

Stripped nitrogen gas is fed from the top end of the column 57 to the conduit 9. The conduit 9 also contains a large percentage of methane gas, which is also stripped in the column 57. The gas in conduit 9, which is at a temperature of −166.8° C. and a pressure of 120 kPa, is fed to the cool end of a heat exchanger 55, in which the gas is warmed to a temperature of about 7° C. The warmed gas is fed from the warm end of the exchanger 55 to a conduit 10, from which it is fed to a fuel gas compressor (not shown). The methane fed through the conduit 10 is used to provide the bulk of the fuel gas requirements of the liquefaction plant.

LNG is fed from the bottom of the column 57 to a conduit 11 and then to a pump 58. The pump 58 pumps the LNG into a conduit 12 and on to a LNG storage tank (see FIGS. 10 and 11). The LNG in conduit 12 is at a temperature of −160.2° C. and a pressure of 170 KPa.

The nitrogen refrigeration cycle which cools the natural gas to a temperature at which it can liquefy will now be described. Nitrogen refrigerant is discharged from the warm end of the exchanger 50 into a conduit 32. The nitrogen in conduit 32 is at a temperature of 7.9° C. and a pressure of 1.14 MPa. The nitrogen is fed to a multistage compressor unit 59, which comprises at least two compressors 69 and 70, with at least one intercooler 71, and an aftercooler 72. The compressors 69 and 70 are driven by a gas turbine 73. The cooling in the intercooler 71 and the aftercooler 72 is provided to return the nitrogen to ambient temperatures. The operation of the compressor unit 59 consumes almost all of the power required by the nitrogen refrigeration cycle. The gas turbine 73 can be driven by the fuel gas derived from conduit 10.

The compressed nitrogen is fed from the compressor unit 59 to a conduit 33 at a pressure of 3.34 MPa and a temperature of 30° C. The conduit 33 leads to two conduits 34 and 35 between which the nitrogen from the conduit 33 is split according to the power absorbed by the compressor. The nitrogen in the conduit 34 is fed to a compressor 62 in which it is compressed to a pressure of about 5.6 MPa, and is then fed from the compressor 62 to a conduit 36. The nitrogen in the conduit 35 is fed to a compressor 63 in which it is compressed to a pressure of about 5.6 MPa, and is then fed from the compressor 63 to a conduit 37. The nitrogen in both the conduits 36 and 37 is fed to a conduit 38 and then to an aftercooler 64, where it is cooled to 30° C. The nitrogen is fed from the aftercooler 64 through a conduit 39 to a heat exchanger 65 in which it is cooled to a temperature of about 10° C. by chilled water. The cooled nitrogen is fed from the exchanger 65 to a conduit 40, which leads to two conduits 20 and 41; the pressure in conduit 40 is 5.5 MPa. The nitrogen flowing through the conduit 40 is split between the conduits 20 and 41: about 2 mol % of the nitrogen in conduit 40 flows through the conduit 41.

The nitrogen flowing through the conduit 41 is fed to the warm end of the heat exchanger 55, where it is cooled to a temperature of about −122.7° C. The cooled nitrogen is fed from the cool end of the exchanger 55 to a conduit 42. The conduit 20 is connected to the warm end of the heat exchanger 50, whereby the nitrogen is fed to the warm end of the heat exchanger 50. The nitrogen from conduit 20 is pre-cooled to −23.9° C. in the heat exchanger 50, and is fed from the cool end of the heat exchanger 50 to a conduit 21.

The conduit 21 leads to two conduits 22 and 23. The nitrogen flowing through the conduit 21 is split between the conduits 22 and 23: about 37 mol % of the total nitrogen flowing through the conduit 21 is fed to the conduit 23. The nitrogen in the conduit 22 is fed to a turbo expander 60, in which it is work expanded to a pressure of 1.18 MPa and a temperature of −105.5° C. The expanded nitrogen exits from the expander 60 into a conduit 28.

The nitrogen in the conduit 23 is fed to the warm end of the heat exchanger 51, in which it is cooled to a temperature of −79.6° C. The nitrogen exits the cool end of the exchanger 51 into a conduit 24, which is connected to a conduit 25. The conduit 42 is also connected to the conduit 25, so that the cooled nitrogen from the heat exchangers 51 and 55 is all fed to the conduit 25. The nitrogen in conduit 25, which is at a temperature of −83.1° C., is fed to a turbo expander 61 in which it is work expanded to a pressure of 1.2 MPa and a coolest nitrogen temperature of −148° C. The expanded nitrogen exits from the expander 61 into a conduit 26.

The turbo expander 60 is arranged to drive the compressor 62, and the turbo expander 61 is arranged to drive the compressor 63. In this way the majority of the work produced by the expanders 60 and 61 can be recovered. In a modification the compressors 62 and 63 can be replaced with a single compressor that is connected to the conduits 33 and 38. This single compressor can be arranged to be driven by the turbo expanders 60 and 61, for example by being connected to a common shaft.

The nitrogen in the conduit 26 is fed to the cool end of the exchanger 53 to cool the natural gas fed to the exchanger 53 from the conduit 5 by countercurrent heat exchange. In the heat exchanger 53 the nitrogen is warmed to an intermediate nitrogen temperature of −105.5° C. The warmed nitrogen exits the warm end of the exchanger 53 into a conduit 27, which is connected to a conduit 29. The conduit 28 is also connected to the conduit 29, whereby the nitrogen from the warm end of the heat exchanger 53 is recombined with the nitrogen from the turbo expander 60.

The nitrogen in the conduit 29, which comprises 100% of the total refrigerant flow, is fed to the cool end of the heat exchanger 52. The nitrogen from the conduit 29 serves to cool the natural gas fed to the exchanger 52 from the conduit 4 by countercurrent heat exchange. The nitrogen flowing through the exchanger 52 is warmed by the natural gas to a temperature of −83.2° C., and exits from the exchanger 52 into a conduit 30.

The nitrogen is fed from the conduit 30 to the cool end of the heat exchanger 51, in which it serves to cool the natural gas fed to the exchanger 51 from the conduit 3, and serves to cool the nitrogen refrigerant fed to the exchanger 51 from the conduit 23, by countercurrent heat exchange. The nitrogen fed to the heat exchanger 51 from the conduit 30 is warmed to about −40° C., and exits the exchanger 51 into a conduit 31.

The nitrogen is fed from the conduit 31 to the cool end of the heat exchanger 50, in which it serves to cool the natural gas fed to the exchanger 50 from the conduit 2, and serves to cool the nitrogen refrigerant fed to the exchanger 50 from the conduit 20, by countercurrent heat exchange. The nitrogen fed to the heat exchanger 50 from the conduit 31 is warmed to 7.9° C., and exits the exchanger 50 into the conduit 32.

Figure 4:
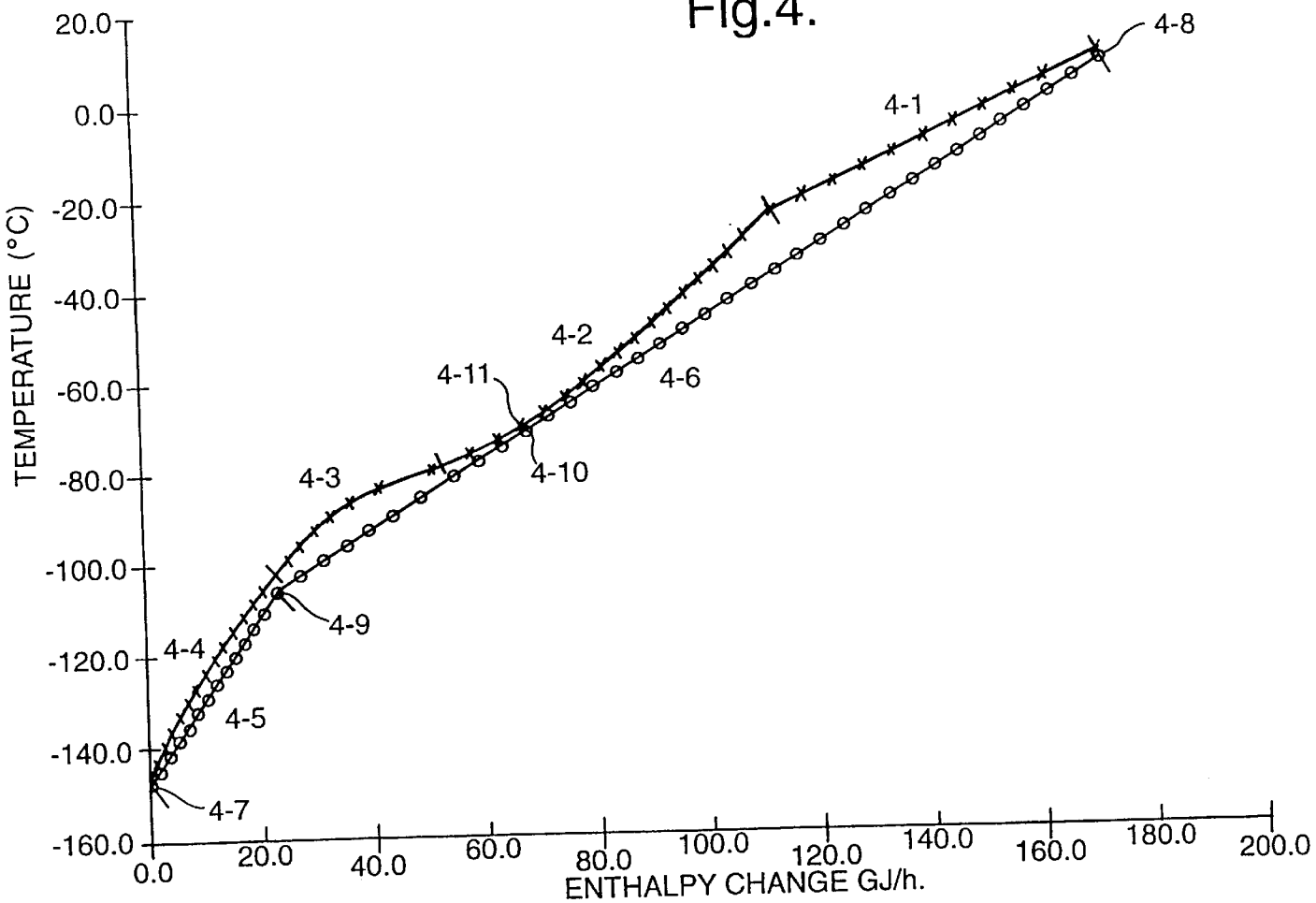
FIG. 4 is a graph of temperature vs. rate of change of enthalpy showing the combined cooling curve for natural gas and nitrogen, and the warming curve for nitrogen for the process illustrated in FIG. 3, when the natural gas has a lean gas composition and the natural gas pressure is about 5.5 MPa.

Reference is now made to FIG. 4, which is a temperature-enthalpy graph representing the process of FIG. 3, in which the natural gas has the lean composition described above. The graph shows a combined cooling curve for the natural gas and the nitrogen refrigerant and a warming curve for the nitrogen refrigerant.

The cooling curve has a plurality of regions identified as 4-1, 4-2, 4-3 and 4-4. The region 4-1 corresponds to cooling in the heat exchanger 50: the gradient in this region is less than what would be the gradient of the cooling curve of natural gas alone over this region; in other words, the presence of the nitrogen refrigerant in the exchanger 50 lowers the gradient in this region. The region 4-2 corresponds to cooling in the heat exchanger 51. The gradient is steeper here, due to the removal of part of the nitrogen refrigerant in conduit 22; the slope of the curve in region 4-2 is closer to the natural gas cooling curve than in region 4-1. The region 4-3 corresponds to cooling in the heat exchanger 52. The gradient here represents the natural gas cooling curve only, because there is no refrigerant being cooled in the heat exchanger 52. This part of the curve represents the region over which liquefaction would take place if the pressure of the natural gas were below the critical pressure. The critical temperature is within the temperature range of region 4-3. The region 4-4 corresponds to cooling in the heat exchanger 53. The gradient is steepest in region 4-4 and represents the sub-cooling of the natural gas. If the natural gas were just below the critical pressure in this region, then it would be a liquid.

The warming curve has two regions identified as 4-5 and 4-6: the region 4-5 corresponds to refrigerant warming in the heat exchanger 53; and the region 4-6 corresponds to refrigerant warming in the heat exchangers 50, 51 and 52. The gradient of the warming curve in region 4-5 is greater than the gradient in the region 4-6: this is due to the smaller mass flow rate of nitrogen in the heat exchanger 53 compared with the mass flow rate in the heat exchangers 50, 51 and 52. A point 4-7 represents the nitrogen temperature in the conduit 26 as it enters the cool end of the heat exchanger 53. A point 4-8 represents the nitrogen temperature in the conduit 32 as it exits the warm end of the heat exchanger 50. The points 4-7 and 4-8 set the end points of the nitrogen warming curve.

The regions 4-5 and 4-6 intersect at a point 4-9, which represents the nitrogen at the nitrogen intermediate temperature as it exits the heat exchanger 53. It is highly advantageous that the point 4-9 is set as warm as possible within the constraints of the system. The nitrogen represented by the point 4-7 should be 1° C. to 5° C. cooler than the temperature of the natural gas exiting the heat exchanger 53 into the conduit 6, and the nitrogen represented by the point 4-9 should be 1° C. to 10° C. cooler than the temperature of the natural gas entering the heat exchanger 53 from the conduit 5; these conditions are necessary to obtain a close match between the natural gas cooling curve and the nitrogen warming curve over the regions 4-4 and 4-5. The temperature of the nitrogen represented by the point 4-9 should be below the critical temperature of the natural gas; this condition is also necessary to obtain a very close match between the natural gas cooling curve and the nitrogen warming curve over the regions 4-4 and 4-5. Finally, the temperature of then nitrogen represented by the point 4-9 needs to be low enough that the straight line region between the point 4-9 and 4-8 does not intersect the natural gas/nitrogen cooling curve in the regions 4-1, 4-2 or 4-3. A point 4-10 on the nitrogen warming curve and 4-11 on the natural gas/nitrogen cooling curve represents the point of closest approach between the natural gas/nitrogen cooling curve and the nitrogen warming curve. An intersection of the two curves at the point 4-10 and 4-11 (or anywhere else) represents a temperature pinch in the heat exchangers. In practice, the point 4-9 should be chosen so that there is a 1° C. to 10° C. temperature difference between the natural gas/nitrogen being cooled at the point 4-11 and the nitrogen being warmed at the point 4-10.

The specific process parameters are heavily dependent upon the natural gas composition. The description in relation to FIGS. 3 and 4 was for a lean gas composition. The process could be used with a rich gas composition, comprising, for example, 4.1 mol % nitrogen, 83.9 mol % methane, 8.7 mol % ethane, 2.8 mol % propane and 0.5 mol % butane. Using such a composition, assuming a feed pressure in conduit 1 of about 5.5 MPa and a natural gas temperature in conduit 2 of 10° C., the pressures in the process are substantially the same as those described above with reference to the lean gas example. However, some of the temperatures are different.

The natural gas emerging from heat exchanger 50 to conduit 3 is at −14° C., the natural gas emerging from heat exchanger 51 to conduit 4 is at −81.1° C., the natural gas emerging from heat exchanger 52 to conduit 5 is at −95.0° C., and the natural gas emerging from heat exchanger 53 to conduit 6 is at −146° C.

As in the FIG. 3 embodiment, about 2.5 mol % of the total nitrogen flowing through the conduit 40 flows through the conduit 41, while the rest flows through the conduit 20. The nitrogen flowing through the conduit 41 emerges from the heat exchanger 155 into the conduit 42 at a temperature of about −105° C. The nitrogen in the conduit 22 is divided between the conduits 22 and 23: about 33 mol % flows through the conduit 23 and about 67 mol % flows through the conduit 22. The nitrogen refrigerant exiting the heat exchanger 50 to the conduit 21 is at −14° C. and the nitrogen refrigerant exiting the heat exchanger 51 to the conduit 24 is at −81.1° C. After mixing the nitrogen from the conduit 24 with the nitrogen from the conduit 42, the nitrogen in the conduit 25 is at a temperature of −83.0° C. The nitrogen refrigerant from the conduit 22 is expanded in the turbo expander 60 to a temperature of 31 98.5° C., while the nitrogen refrigerant from the conduit 25 is expanded in the turbo expander 61 to a temperature of −148° C.

The nitrogen refrigerant exits from the heat exchanger 53 to the conduit 27 at −98.5° C., is combined with the refrigerant from the conduit 28, is passed through the heat exchanger 52, and exits from the heat exchanger 52 to the conduit 30 at a temperature of −92.1° C. Subsequently, the nitrogen refrigerant exits from the heat exchanger 51 to the conduit 31 at a temperature of about −24.4° C.

The temperature of the nitrogen exiting from the top of the column 57 to the conduit 9 is −164.1° C., and the temperature of the LNG product in conduit 12 is −158.4° C.

Figure 5:
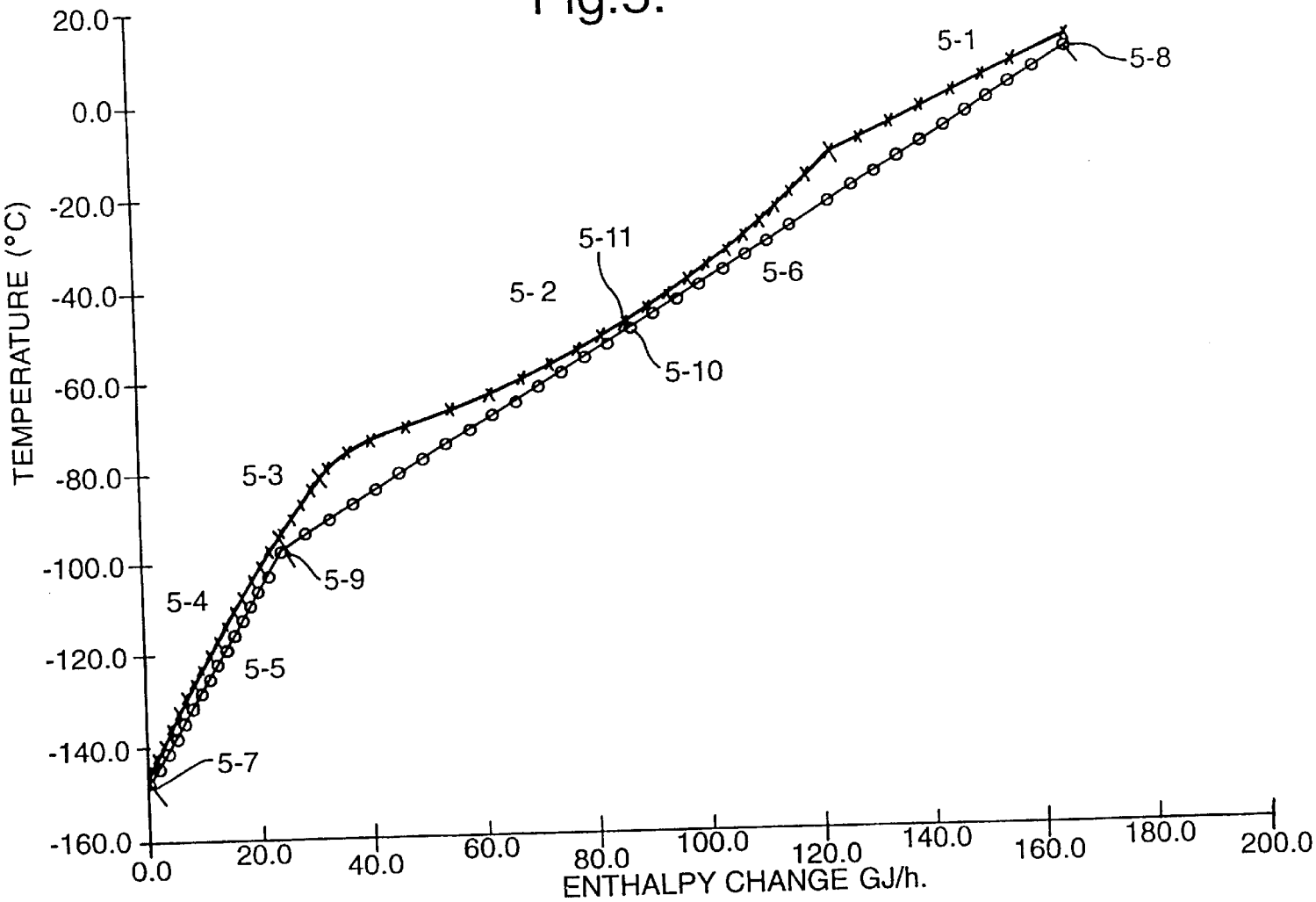
FIG. 5 is a graph of temperature vs. rate of change of enthalpy showing the combined cooling curve for natural gas and nitrogen, and the warming curve for nitrogen for the process illustrated in FIG. 3, when the natural gas has a rich gas composition and the natural gas pressure is about 5.5 MPa.

FIG. 5 is similar to FIG. 4, and shows a temperature-enthalpy graph representing the process of FIG. 3, where the natural gas has the rich composition described above. The graph shows a combined cooling curve for the natural gas and the nitrogen refrigerant and a warming curve for the nitrogen refrigerant. The cooling and warming curves have a plurality of regions identified as 5-1 to 5-6, which correspond to regions 4-1 to 4-6 respectively of FIG. 4, and have a plurality of temperature points 5-7 to 5-11, which correspond to regions 4-7 to 4-11 respectively of FIG. 4. The description above, relating the FIG. 4, also applies to FIG. 5, with the exception that in FIG. 5, the natural gas critical temperature is in the region 5-2, rather than 5-3.

Figure 6:
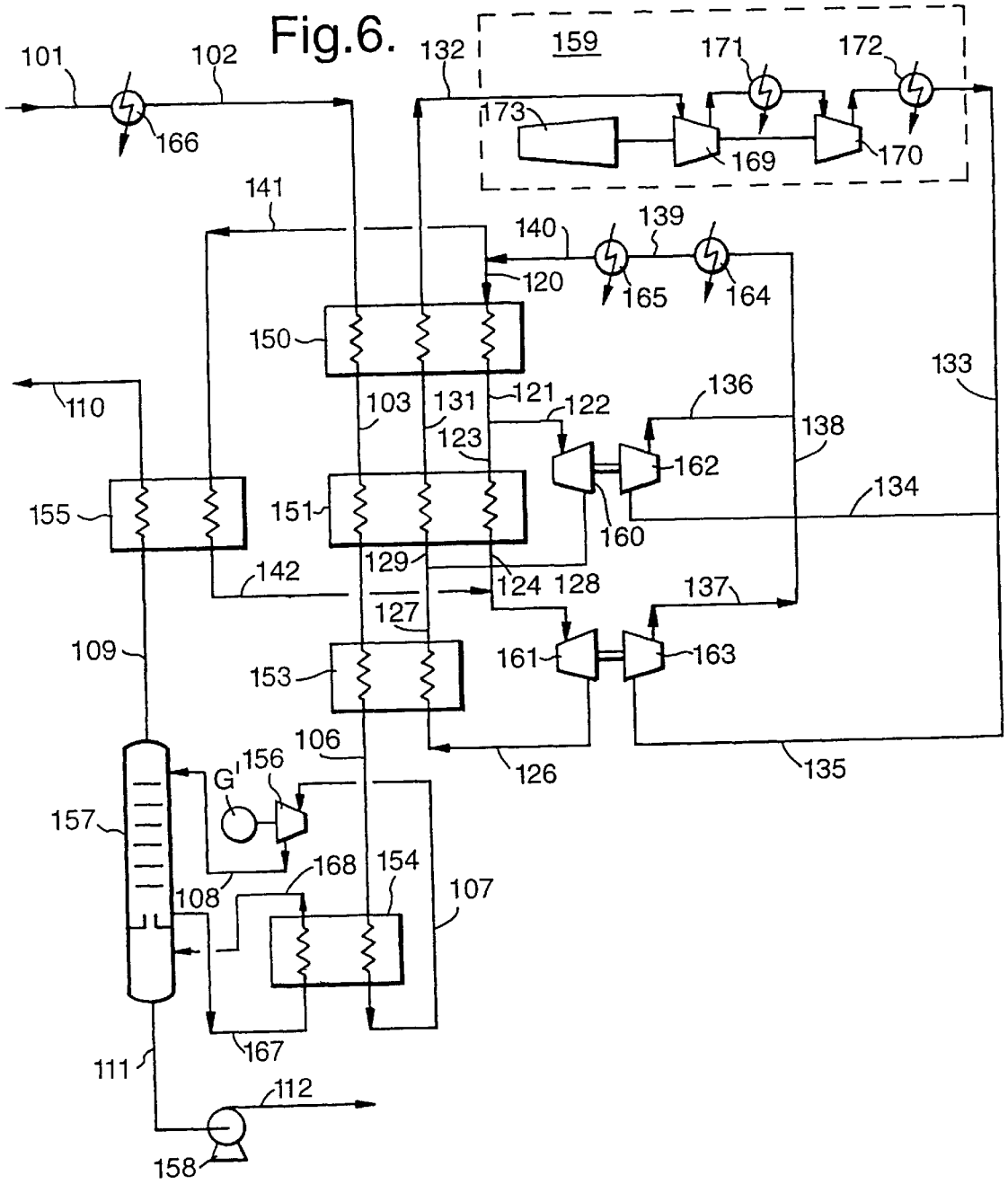
FIG. 6 is a schematic diagram of another embodiment of apparatus for the process according to the present invention.

Referring now to FIG. 6, another embodiment of an apparatus for the present invention is shown. The FIG. 6 embodiment bears many similarities to the FIG. 3 embodiment, and the reference numerals given to the parts in FIG. 6 are exactly 100 higher than the equivalent parts in the FIG. 3 embodiment. The embodiment shown in FIG. 6 is preferred to the embodiment shown in FIG. 3, because fewer heat exchangers are required.

Lean natural gas is fed from a pre-treatment plant (not shown) to conduit 101. The natural gas in conduit 101 comprises 5.7 mol % nitrogen, 94.1 mol % methane and 0.2 mol % ethane, and is at a pressure of about 5.5 MPa. As discussed above, various pre-treatment arrangements are known in the art and the exact configuration depends on the composition of the natural gas recovered from the ground, including the level of undesirable contaminants. Typically the pre-treatment plant would remove carbon dioxide, water, sulphur compounds, mercury contaminants and heavy hydrocarbons.

The natural gas in conduit 101 is fed to heat exchanger 166, where it is cooled to 10° C. with chilled water. The exchanger 166 could be provided as part of the pre-treatment plant. In particular, the exchanger could be provided upstream of a water removal unit of the pre-treatment plant, in order to allow condensation and separation of the water contained in the natural gas, and to minimise the size of equipment.

The natural gas exiting the heat exchanger 166 is fed to conduit 102 from where it is passed to the warm end of a series of heat exchangers 150, 151 and 153. The series of heat exchangers 150 to 153 cool the natural gas to a temperature sufficiently low that it can be liquefied when flashed to a pressure (usually about atmospheric pressure) below the critical pressure of the natural gas. It will be noted that in the embodiment of FIG. 6 there is no heat exchanger equivalent to the heat exchanger 52 of FIG. 3.

The natural gas in conduit 102, at a temperature of about 10° C., is first fed to the warm end of the heat exchanger 150. The natural gas is cooled in heat exchanger 150 to −41.7° C., and is passed from the cool end of the exchanger 150 to a conduit 103. The natural gas in conduit 103 is fed to the warm end of the exchanger 151, in which it is cooled to a temperature of about −98.2° C. The natural gas exits the cool end of the exchanger 151 into a conduit 104, from which it is fed to the warm end of the exchanger 153, in which it is cooled to a temperature of −146° C. The natural gas exits the cool end of the exchanger 153 into a conduit 106.

The natural gas in conduit 106 is fed to the warm end of a heat exchanger 154, in which it is cooled to a temperature of about −158° C., and it exits the cool end of the exchanger 154 into a conduit 107. The natural gas in conduit 107, which is still at supercritical pressure, is fed to a liquid expansion turbine 156 in which the natural gas is substantially isentropically expanded to a pressure of about 150 kPa. In the turbine 56 the natural gas is liquefied, and is reduced in temperature to about −167° C. The turbine 156 drives an electrical generator G' to recover the work as electrical power.

The fluid exiting the turbine 156 is fed to a conduit 108. This fluid is predominantly liquid natural gas, with some natural gas in the gaseous state. The fluid in conduit 108 is fed to the top of a fractionating column 157. The natural gas feed in conduit 1 contains about 6 mol % of nitrogen: the fractionating column 57 serves to strip the nitrogen from the LNG. The stripping process is assisted by using the exchanger 154 to provide reboil heat transferred from the natural gas in conduit 106. LNG is fed from the column 157 to conduit 167, from where the LNG is fed to the cool end of the exchanger 154. The exchanger 154 warms the LNG to a temperature of about −160° C.; the LNG exits the warm end of the exchanger 154 into a conduit 168, through which it is fed back to the column 157.

Stripped nitrogen gas is fed from the top end of the column 157 to the conduit 109. The conduit 109 also contains a large percentage of methane gas, which is also stripped in the column 57. The gas in conduit 109, which is at a temperature of −166.8° C. and pressure of 120 kPa, is fed to the cool end of a heat exchanger 155, in which the gas is warmed to a temperature of about 7° C. The warmed gas is fed from the warm end of the exchanger 105 to a conduit 110, from which it is fed to a fuel gas compressor (not shown). The methane fed through the conduit 110 is used to provide the bulk of the fuel gas requirements of the liquefaction plant.

LNG is fed from the bottom of the column 157 to a conduit 111 and then to a pump 158. The pump 158 pumps the LNG into a conduit 112 and on to a LNG storage tank (see FIGS. 10 and 11).

The nitrogen refrigeration cycle which cools the natural gas to a temperature at which it can liquefy will now be described. Nitrogen refrigerant is discharged from the warm end of the exchanger 150 into a conduit 132. The nitrogen in conduit 132 is at a temperature of about 7.9° C. and a pressure of 1.66 MPa. The nitrogen is fed to a multistage compressor unit 159, which comprises at least two compressors 169 and 170, with at least one intercooler 171, and an aftercooler 172. The compressors 169 and 170 are driven by a gas turbine 173. The cooling in the intercooler 171 and the aftercooler 172 is provided to return the nitrogen to ambient temperatures. The operation of the compressor unit 159 consumes almost all of the power required by the nitrogen refrigeration cycle. The gas turbine 173 can be driven by the fuel gas derived from conduit 110.

The compressed nitrogen is fed from the compressor unit 159 to a conduit 133 at a pressure of 3.79 MPa. The conduit 133 leads to two conduits 134 and 135 between which the nitrogen from the conduit 133 is split according to the power absorbed by the compressor. The nitrogen in the conduit 134 is fed to a compressor 162 in which it is compressed to a pressure of about 5.5 MPa, and is then fed from the compressor 162 to conduit a 136. The nitrogen in the conduit 135 is fed to a compressor 163 in which it is compressed to a pressure of about 5.5 MPa, and is then fed from the compressor 163 to conduit a 137. The nitrogen in both the conduits 136 and 137 is fed to a conduit 138 and then to an aftercooler 164, where it is cooled back to ambient temperatures. The nitrogen is fed from the aftercooler 164 through a conduit 139 to a heat exchanger 165 in which it is cooled to a temperature of 10° C. by chilled water. The cooled nitrogen is fed from the exchanger 165 to a conduit 140, which leads to two conduits 120 and 141. The nitrogen flowing through the conduit 140 is split between the conduits 120 and 141: about 2 mol % of the nitrogen in conduit 140 flows through the conduit 121.

The nitrogen flowing through the conduit 141 is fed to the warm end of the heat exchanger 155, where it is cooled to a temperature of about −123° C. The cooled nitrogen is fed from the cool end of the exchanger 155 to a conduit 142. The conduit 120 is connected to the warm end of the heat exchanger 150, whereby the nitrogen is fed to the warm end of the heat exchanger 150. The nitrogen from conduit 120 is pre-cooled to −41.7° C. in the heat exchanger 150, and is fed from the cool end of the heat exchanger 150 to a conduit 121.

The conduit 121 leads to two conduits 122 and 123. The nitrogen flowing through the conduit 121 is split between the conduits 122 and 123: about 26 mol % of the total nitrogen flowing through the conduit 121 is fed to the conduit 123. The nitrogen in the conduit 122 is fed to a turbo expander 160, in which it is work expanded to a pressure of 1.73 MPa and a temperature of −102.5° C. The expanded nitrogen exits from the expander 160 into a conduit 128.

The nitrogen in the conduit 123 is fed to the warm end of the heat exchanger 151, in which it is cooled to a temperature of about −98.2° C. The nitrogen exits the cool end of the exchanger 151 into a conduit 124, which is connected to a conduit 125. The conduit 42 is also connected to the conduit 125, so that the cooled nitrogen from the heat exchangers 151 and 155 is all fed to the conduit 125. The nitrogen in conduit 125, which is at a temperature of −100.3° C., is fed to a turbo expander 161 in which it is work expanded to a pressure of 1.76 MPa and a coolest nitrogen temperature of about −148° C. The expanded nitrogen exits from the expander 161 into a conduit 126.

The turbo expander 160 is arranged to drive the compressor 162, and the turbo expander 161 is arranged to drive the compressor 163. In this way the majority of the work produced by the expanders 160 and 161 can be recovered. In a modification the compressors 162 and 163 can be replaced with a single compressor that is connected to the conduits 133 and 138. This single compressor can be arranged to be driven by the turbo expanders 160 and 161, for example by being connected to a common shaft.

The nitrogen in the conduit 126 is fed to the cool end of the exchanger 153 to cool the natural gas fed to the exchanger 153 from the conduit 104 by countercurrent heat exchange. In the heat exchanger 153 the nitrogen is warmed to an intermediate nitrogen temperature of −102.5° C. The warmed nitrogen exits the warm end of the exchanger 153 into a conduit 127, which is connected to a conduit 129. The conduit 128 is also connected to the conduit 129, whereby the nitrogen from the warm end of the heat exchanger 153 is recombined with the nitrogen from the turbo expander 160.

The nitrogen is fed from the conduit 129 to the cool end of the heat exchanger 151, in which it serves to cool the natural gas fed to the exchanger 151 from the conduit 103, and serves to cool and nitrogen refrigerant fed to the exchanger 151 from the conduit 123, by countercurrent heat exchange. The nitrogen fed to the heat exchanger 151 from the conduit 129 is warmed to about −57.9° C., and exits the exchanger 151 into a conduit 131.

The nitrogen is fed from the conduit 131 to the cool end of the heat exchanger 150, in which it serves to cool the natural gas fed to the exchanger 150 from the conduit 102, and serves to cool the nitrogen refrigerant fed to the exchanger 150 from the conduit 120, by countercurrent heat exchange. The nitrogen fed to the heat exchanger 150 from the conduit 131 is warmed to 7.9° C., and exits the exchanger 150 into the conduit 132.

Figure 7:
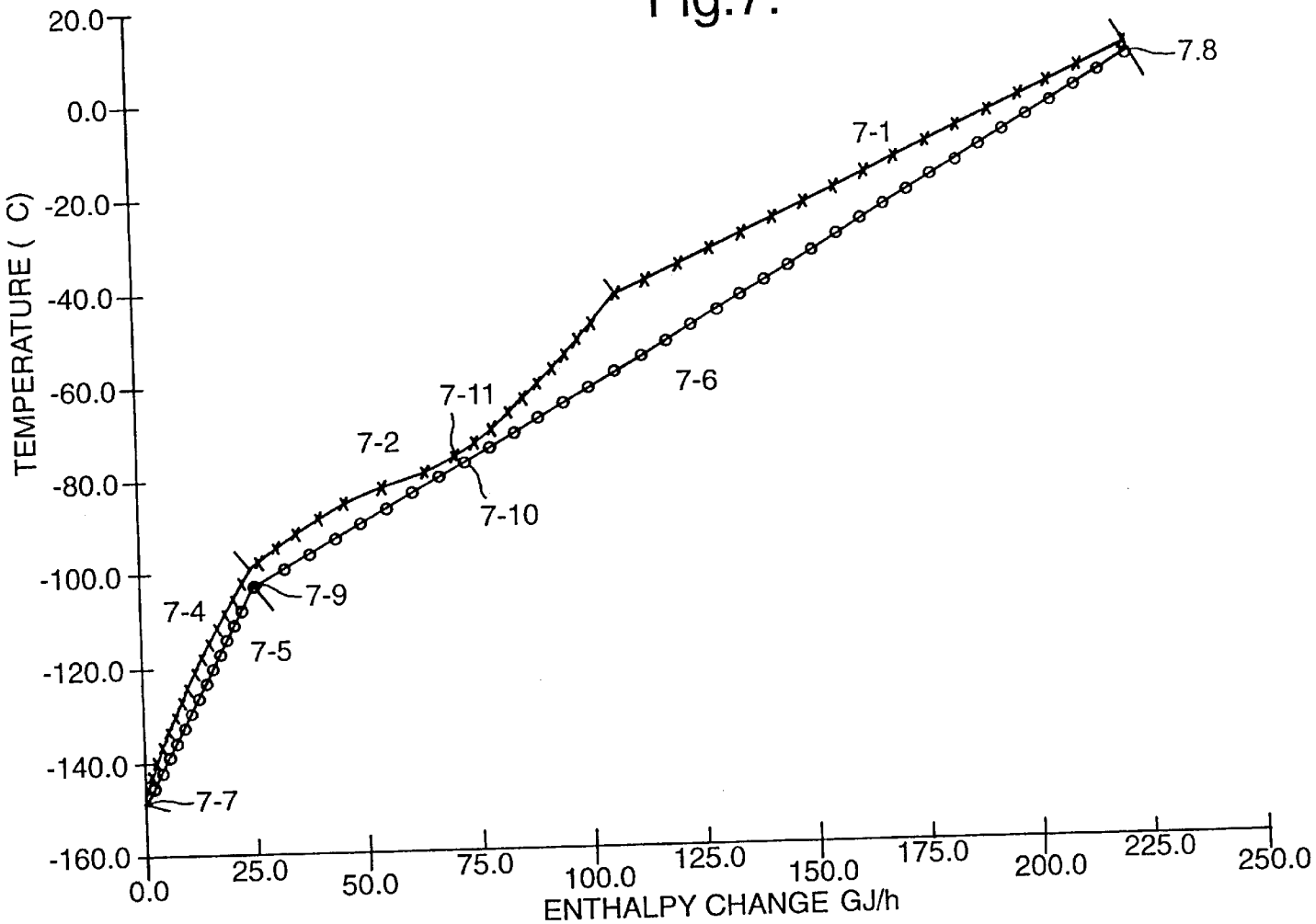
FIG. 7 is a graph of temperature vs. rate of change of enthalpy showing the combined cooling curve for natural gas and nitrogen, and the warming curve for nitrogen for the process illustrated in FIG. 6, in which the natural gas has a lean gas composition and the natural gas pressure is about 5.5 MPa.

FIG. 7 is similar to FIG. 4, and shows a temperature-enthalpy graph representing the process of FIG. 6, where the natural gas has the lean composition described above. The graph shows a combined cooling curve for the natural gas and the nitrogen refrigerant and a warming curve for the nitrogen refrigerant.

The cooling curve has a plurality of regions identified as 7-1, 7-2 and 7-4. The region 7-1 corresponds to cooling in the heat exchanger 150: the gradient in this region is less than what would be the gradient of the cooling curve of natural gas alone over the region; in other words, the presence of the nitrogen refrigerant in the exchanger 150 lowers the gradient in this region. The region 7-2 corresponds to cooling in the heat exchanger 151. The gradient is steeper here, due to the removal of part of the nitrogen refrigerant in conduit 122; the slope of the curve in region 7-2 is closer to the natural gas cooling curve than in region 7-1. This part of the curve also represents the region over which liquefaction would take place if the pressure of the natural gas were below the critical pressure: the critical temperature is within the temperature range of region 7-2. The region 7-4 corresponds to cooling in the heat exchanger 153. The gradient is steepest in region 7-4 and represents the sub-cooling of the natural gas. Note that there is no region 7-3 in FIG. 7, because there is no heat exchanger 152.

The nitrogen warming curve has two regions identified as 7-5 and 7-6: the region 7-5 corresponds to refrigerant warming in the heat exchanger 153; and the region 7-6 corresponds to refrigerant warming in the heat exchangers 150 and 151. The gradient of the warming curve in region 7-5 is greater than the gradient in the region 7-6: this is due to the smaller mass flow rate of nitrogen in the heat exchanger 153 compared with the mass flow rate in the heat exchangers 150 and 151. A point 7-7 represents the nitrogen temperature in the conduit 126 as it enters the cool end of the heat exchanger 153. A point 7-8 represents the nitrogen temperature in the conduit 132 as it exits the warm end of the heat exchanger 150. The points 7-7 and 7-8 set the end points of the nitrogen warming curve.

The regions 7-5 and 7-6 intersect at a point 7-9, which represents the nitrogen at the nitrogen intermediate temperature as it exits the heat exchanger 153. It is highly advantageous that the point 7-9 is set as warm as possible within the constraints of the system. The nitrogen represented by the point 7-7 should be 1° C. to 5° C. cooler than the temperature of the natural gas exiting the heat exchanger 153 into the conduit 106, and the nitrogen represented by the point 7-9 should be 1° C. to 10° C. cooler than the temperature of the natural gas entering the heat exchanger 153 from the conduit 105; these conditions are necessary to obtain a very close match between the natural gas cooling curve and the nitrogen warming curve over the regions 7-4 and 7-5. The temperature of the nitrogen represented by the point 8.9 should be below the critical temperature of the natural gas: this condition is also necessary to obtain a very close match between the natural gas cooling curve and the nitrogen warming curve over the regions 7-4 and 7-5. Finally, the temperature of the nitrogen represented by the point 7-9 needs to be low enough that the straight line region between the point 7-9 and 7-8 does not intersect the natural gas/nitrogen cooling curve in the regions 7-1 or 7-2. A point 7-10 on the nitrogen warming curve and 7-11 on the natural gas/nitrogen cooling curve represents the point of closest approach between the natural gas/nitrogen cooling curve and the nitrogen warming curve. An intersection of the two curves at the point 7-10 and 7-11 (or anywhere else) represents a temperature pinch in the heat exchangers. In practice, the point 7-9 should be chosen so that there is a 1° C. temperature difference between the natural gas/nitrogen being cooled at the point 7-11 and the nitrogen being warmed at the point 7-10.

The process of FIG. 6 will now be considered for a rich gas composition, comprising 4.1 mol % nitrogen, 83.9 mol % methane, 8.7 mol % ethane, 2.8 mol % propane and 0.5 mol % butane, using a natural gas feed pressure in conduit 1 of about 7.6 MPa and a natural gas temperature in conduit 102 of 10° C.

Under these new conditions, the natural gas would exit from the heat exchanger 150 into the conduit 103 at a temperature of −8.0° C., the natural gas would exit from the heat exchanger 151 into the conduit 104 at a temperature of −87° C., and the natural gas would exit from the heat exchanger 153 into the conduit 106 at a temperature of −146° C.

The nitrogen refrigerant exiting from the heat exchanger into the conduit 132 is at a temperature of 7.9° C. and a pressure of 2.31 MPa. The nitrogen refrigerant is compressed in the compressor unit 159 to a pressure of 6.08 MPa, and is then further compressed in the compressors 162 and 163 to a pressure of about 10 MPa.

The nitrogen refrigerant in the conduit 140 is at a temperature of 10.0° C., as a result of the cooling in the aftercooler 164 and the heat exchanger 165. About 2.2 mol % of the nitrogen flowing through the conduit 140 flows through the conduit 141, while the remainder flows through the conduit 120. The nitrogen flowing through the conduit 141 is reduced in temperature to about −108° C. in the heat exchanger 155.

The nitrogen refrigerant exiting the heat exchanger 150 into the conduit 121 it at a temperature of −8° C. About 25 mol % of the nitrogen in the conduit 121 flows through the conduit 123, while the remaining 75 mol % flows through the conduit 122. The nitrogen flowing through the conduit 123 emerges from the heat exchanger 151 at a temperature of −87° C., from where it flows into the conduit 125 along with the nitrogen from the conduit 142: the temperature of the nitrogen in the conduit 125 is −88.7° C. The nitrogen flowing through the conduit 122 is expanded in the turbo expander 160 to a pressure of 2.39 MPa and a temperature of −90.5° C., and the nitrogen flowing through the conduit 125 is expanded in the turbo expander 161 to a pressure of 2.42 MPa and a temperature of −148° C.

The nitrogen refrigerant emerging from the heat exchanger 153 into the conduit 127 is at a temperature of −90.5° C., and the nitrogen refrigerant emerging from the heat exchanger 151 into the conduit 131 is at a temperature of about −18° C.

Figure 8:
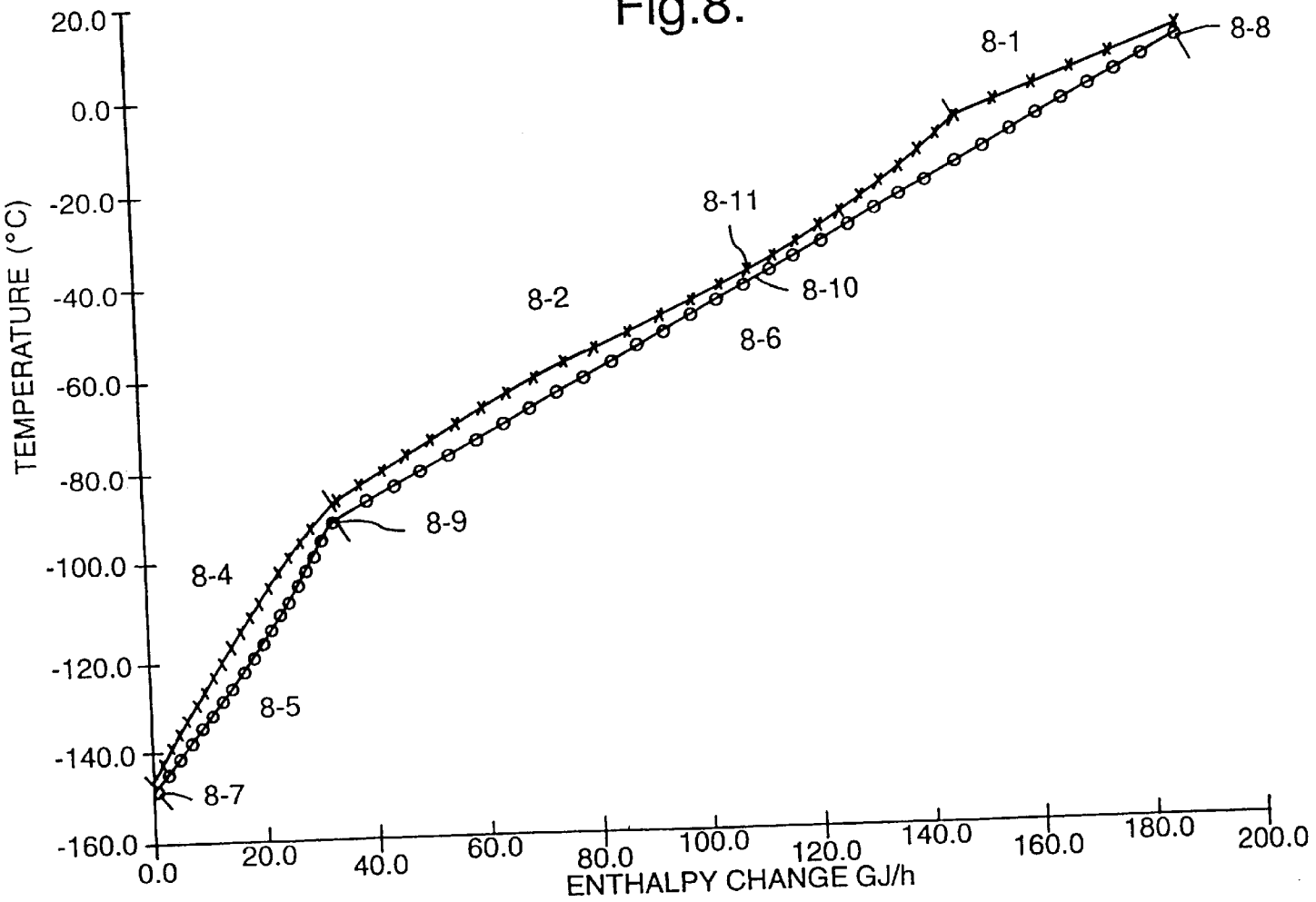
FIG. 8 is a graph of temperature vs. rate of change of enthalpy showing the combined cooling curve for natural gas and nitrogen, and the warming curve for nitrogen for the process illustrated in FIG. 6, in which the natural gas has a rich gas composition and the natural gas pressure is about 7.7 MPa.

FIG. 8 is similar to FIG. 7, and shows a temperature-enthalpy graph representing the process of FIG. 6, where the natural gas has the rich composition described above, and is supplied at a pressure of about 7.6 MPa. The graph shows a combined cooling curve for the natural gas and the nitrogen refrigerant and a warming curve for the nitrogen refrigerant. The cooling and warming curves have a plurality of regions 8-1 to 8-6, which correspond to regions 7-1 to 7-6 respectively of FIG. 7, and have a plurality of temperature points 8-7 to 8-11, which correspond to temperature points 7-7 to 7-11 respectively of FIG. 7. The description above, relating to FIG. 7, also applies to FIG. 8.

The process of FIG. 6 will now be considered for a rich gas composition, comprising 4.1 mol % nitrogen, 84.1 mol % methane, 8.5 mol % ethane, 2.6 mol % propane and 0.7 mol % butane, using a natural gas feed pressure in conduit 1 of about 8.25 MPa and a natural gas temperature in conduit 102 of 10° C. There is one slight modification to the process described above with respect to FIG. 6: boil-off gas from LNG storage tanks is combined with the top product from column 157 in conduit 109, and the combined contents of the conduit 109 are fed to the heat exchanger 155.

Under these new conditions, the natural gas would exit from the heat exchanger 151 into the conduit 104 at a temperature of −86.2° C., and would exit from the heat exchanger 153 into the conduit 106 at a temperature of −148.3° C.

The nitrogen refrigerant exiting from the heat exchanger into the conduit 132 is at a temperature of 3.0° C. and a pressure of 1.77 MPa. The nitrogen refrigerant is compressed in the compressor unit 159 to a pressure of 4.97 MPa, and is then further compressed in the compressors 162 and 163 to a pressure of about 8.3 MPa.

The nitrogen refrigerant in the conduit 140 is at a temperature of 10.0° C., as a result of the cooling in the aftercooler 164 and the heat exchanger 165. About 1.7 mol % of the nitrogen flowing through the conduit 140 flows through the conduit 141, while the remainder flows through the conduit 120. The nitrogen flowing through the conduit 141 is reduced in temperature to about −143° C. in the heat exchanger 155.

The nitrogen refrigerant exiting the heat exchanger 150 into the conduit 121 is at a temperature of −7° C. About 31 mol % of the nitrogen in the conduit 121 flows through the conduit 123, while the remaining 69 mol % flows through the conduit 122. The nitrogen flowing through the conduit 123 emerges from the heat exchanger 151 at a temperature of −86.2° C., from where it flows into the conduit 125 along with the nitrogen from the conduit 142; the temperature of the nitrogen in the conduit 125 is −89.3° C. The nitrogen flowing through the conduit 122 is expanded in the turbo expander 160 to a pressure of 1.84 MPa and a temperature of −93.2° C., and the nitrogen flowing through the conduit 125 is expanded in the turbo expander 161 to a pressure of 1.87 MPa and a temperature of −152.2° C.

The nitrogen refrigerant emerging from the heat exchanger 153 into the conduit 127 is at a temperature of −93.2° C.

Figure 9:
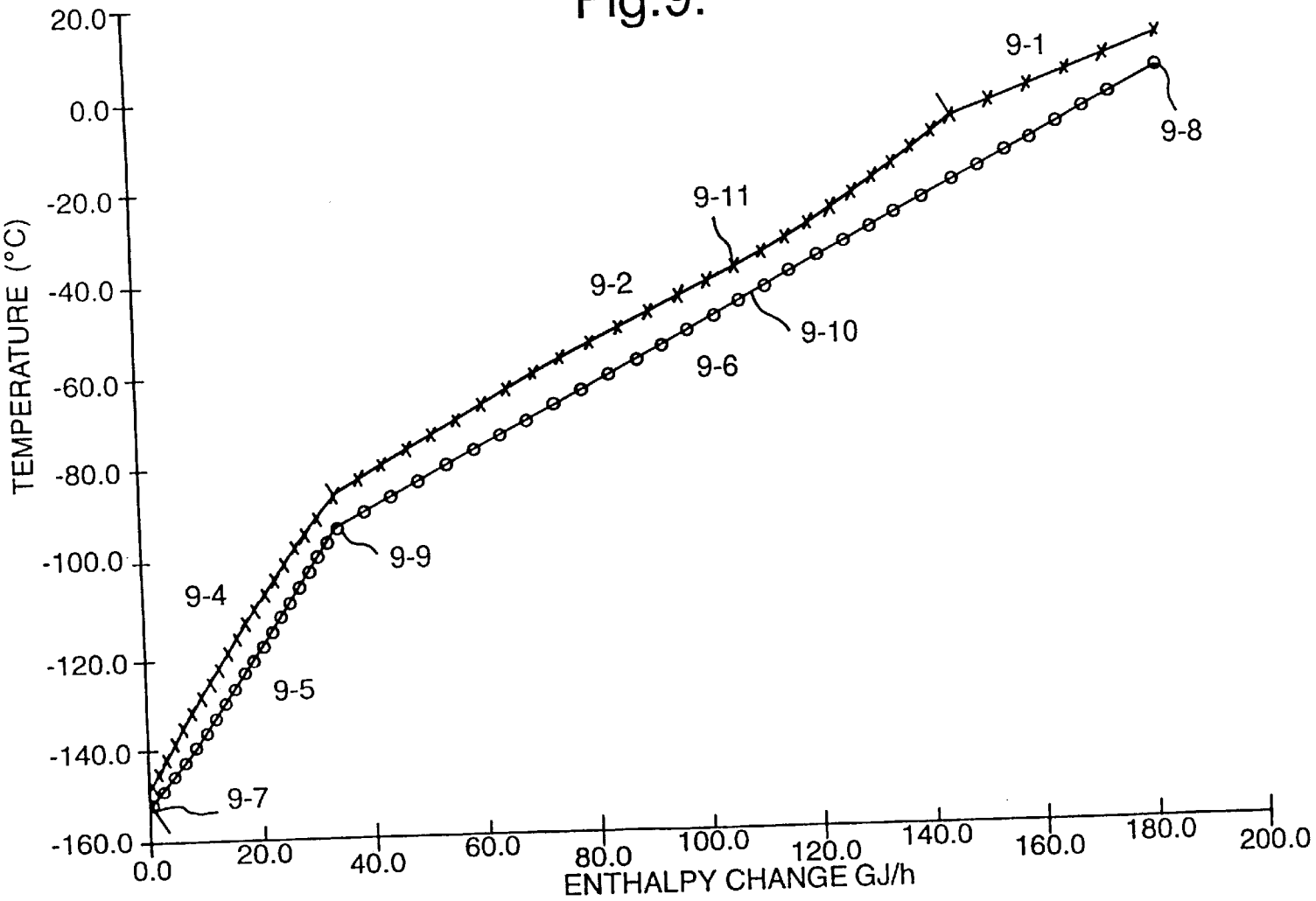
FIG. 9 is a graph of temperature vs. rate of change of enthalpy showing the combined cooling curve for natural gas and nitrogen, and the warming curve for nitrogen for the process illustrated in FIG. 6, in which the natural gas has a rich gas composition and the natural gas pressure is about 8.3 MPa.

FIG. 9 is similar to FIG. 7, and shows a temperature-enthalpy graph representing the process of FIG. 6, where the natural gas has the rich composition described above, and is supplied at a pressure of about 8.25 MPa. The graph shows a combined cooling curve for the natural gas and the nitrogen refrigerant and a warming curve for the nitrogen refrigerant. The cooling and warming curves have a plurality of regions 9-1 to 9-6, which correspond to regions 7-1 to 7-6 respectively of FIG. 7, and have a plurality of temperature points 9-7 to 9-11, which correspond to temperature points 7-7 to 7-11 respectively of FIG. 7. The description above, relating to FIG. 7, also applies to FIG. 9.

In FIG. 9 the minimum temperature difference between the two curves is 3.9° C., while in FIGS. 4, 5, 7 and 8, the minimum temperature difference is 2° C.

Figure 10:
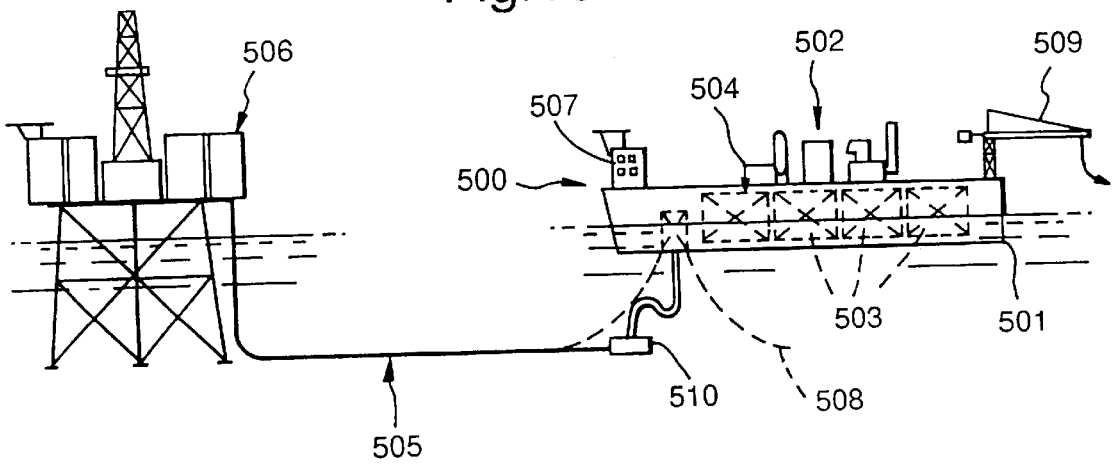
FIG. 10 is a schematic diagram of one embodiment of a natural gas liquefaction apparatus according to the present invention.

Referring to FIG. 10 an embodiment of an apparatus for producing LNG is generally designated 500. The apparatus comprises a floating platform in the form of a ship 501, which carries a natural gas liquefaction plant 502 and LNG storage tanks 503. The LNG is fed from the plant 502 to the storage tanks 503 via a conduit 504. The natural gas is supplied to the plant 502 via a pipeline 505, which extends to a natural gas rig 506, and via a riser and manifold arrangement 510, which extends from the ship 501 to the pipeline 505. It is possible for the natural gas to be supplied from a plurality of said gas rigs 506. A pre-treatment plant (not shown) may be provided for the natural gas, before it is fed to the plant 502. The pre-treatment plant may be provided on the rig 506, on a separate unit (not shown) or on the ship 501.

The ship 501 also includes accommodation 507, mooring lines 508, and means 509 for supplying LNG from the storage tanks 503 to an LNG carrier (not shown).

Figure 11:
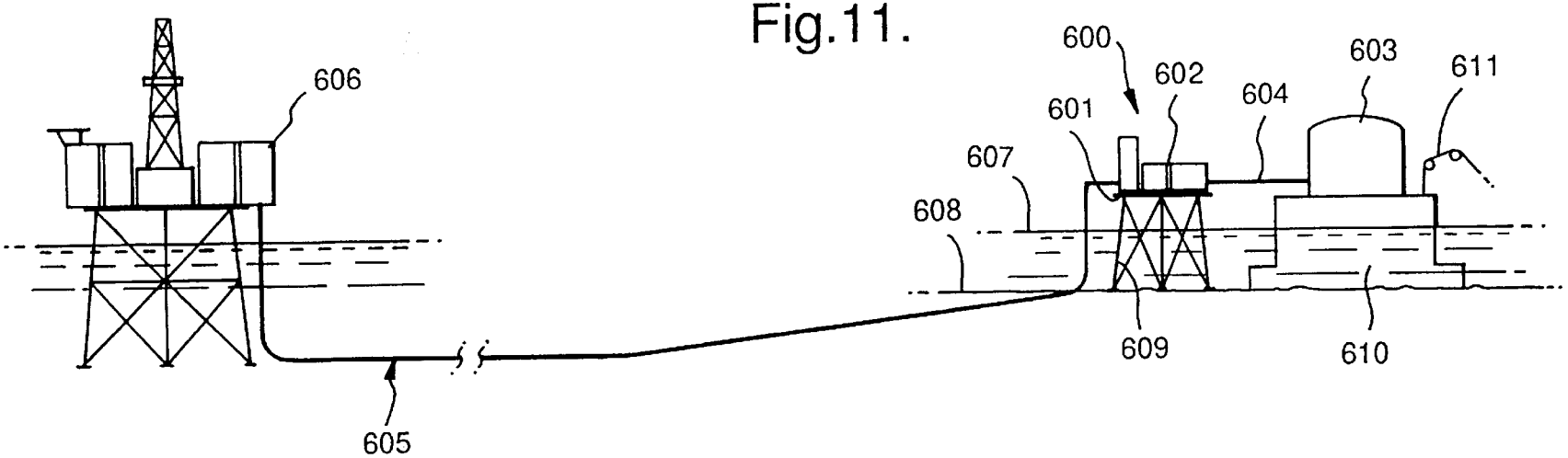
FIG. 11 is a schematic diagram of another embodiment of a natural gas liquefaction apparatus according to the present invention.

Referring to FIG. 11 another embodiment of an apparatus for producing LNG is generally designated 600. The apparatus comprises platform 601, which is supported above the water level 607 by legs 609, a natural gas liquefaction plant 602 and an LNG storage tank 603. The LNG is fed from the plant 602 to the storage tank 603 via a conduit 604. The storage tank 603 is supported by a concrete gravity base 610, which rests on seabed 608. The natural gas is supplied to the plant 602 via a pipeline 605, which communicates with a natural gas rig 606. It is possible for the natural gas to be supplied from a plurality of said gas rigs 606. A pre-treatment plant (not shown) may be provided for the natural gas, before it is fed to the plant 602. The pre-treatment plant may be provided on the rig 606, on a separate unit (not shown), on the platform 601 or on the gravity base 610. Means 611 is provided for supplying LNG from the storage tanks 603 to a LNG carrier (not shown). In a modification the apparatus 600 could be provided on the rig 606.

Figure 12:
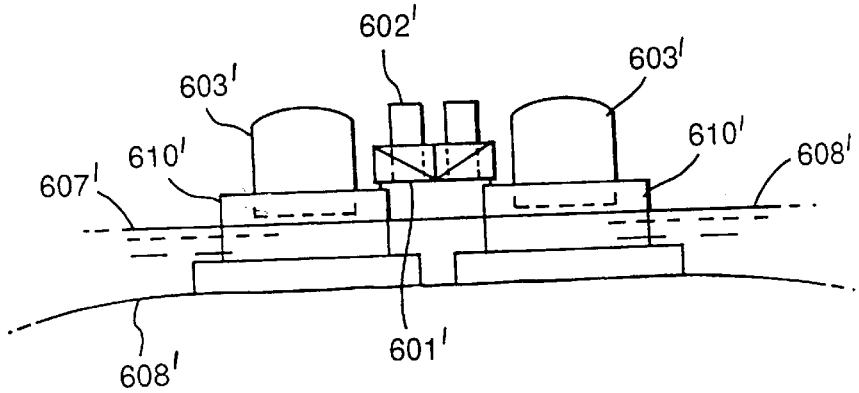
FIG. 12 is a schematic diagram of another embodiment of a natural gas liquefaction apparatus according to the present invention.

FIG. 12 shows a modification of the LNG apparatus 600 shown in FIG. 11. In FIG. 12 the modified LNG apparatus is generally designated 600' and comprises two spaced concrete gravity bases 610', which rest on the seabed 608', so that they project above the water level 607'. A liquefaction plant 602' is provided on a platform 601', which rests on the gravity bases 610' and bridges the gap between the gravity bases 610'. An LNG storage tank 603' is provided on each of the gravity bases 610'.

The platform 601' can be installed by supporting it on a barge (not shown): floating the barge into the gap between the gravity bases 610' so that the platform 601' projects over the upper surface of each gravity base 610'; lowering the barge so that the platform 601' rests on the gravity bases 610'; and finally floating the barge out of the gap between the gravity bases 610'.

Figure 13:
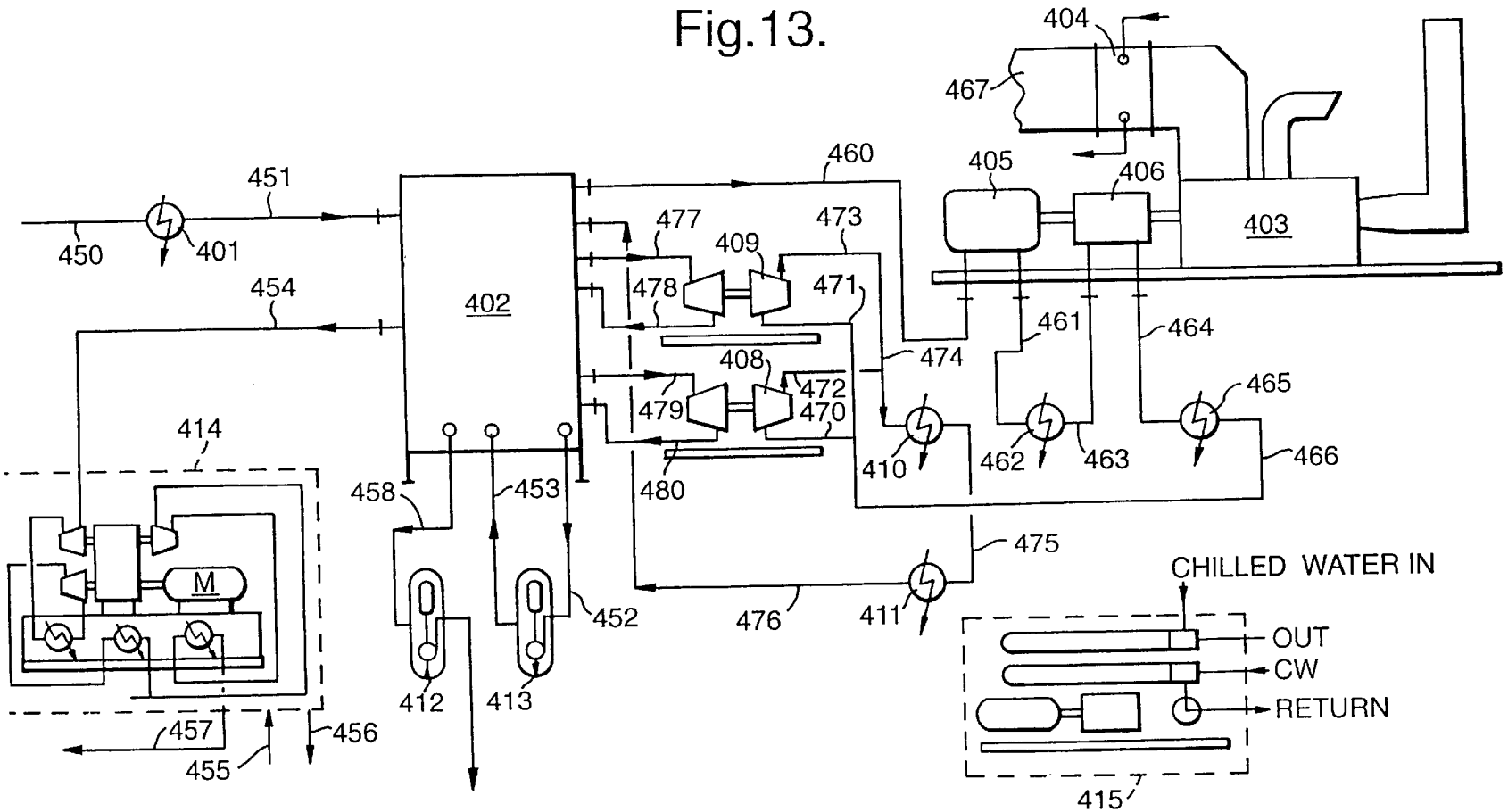
FIG. 13 is a schematic diagram of one embodiment of a part of the apparatus shown in FIGS. 10 to 12.

Referring to FIG. 13, the natural gas liquefaction plants 502, 602 and 602' of FIGS. 10 to 12 are shown in more detail. In general, the components of the plant shown in FIG. 13 are similar to the components shown in FIGS. 3 and 6. Natural gas is supplied to conduit 450 of the plant at high pressure, which may be supercritical; the natural gas may have been pre-treated to remove contaminants using conventional processes. The natural gas in conduit 450 is fed to a heat exchanger 401 in which it is cooled with chilled water supplied from a chilled water refrigeration unit 415. The heat exchanger 401 may, instead, be incorporated in the pretreatment process. The heat exchanger 401 may be a conventional shell and tube heat exchanger, or any other type of heat exchanger suitable for cooling natural gas with chilled water, including a PCHE.

Figure 14:
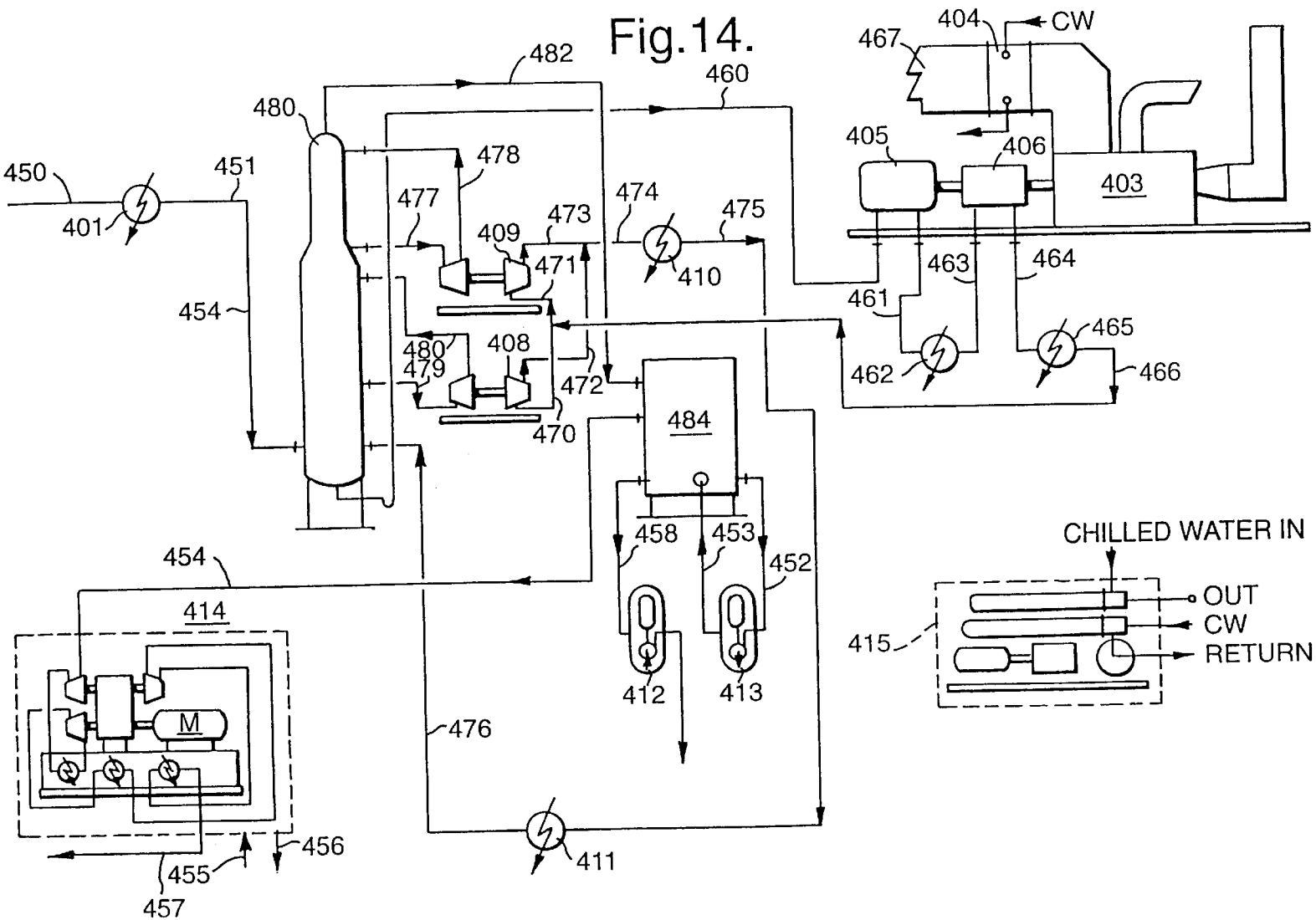
FIG. 14 is a schematic diagram of another embodiment of a part of the apparatus shown in FIGS. 10 to 12.

The cooled natural gas exits from the heat exchanger 401 to a conduit 451, through which it is fed to a cold box 402, where the gas is progressively cooled to a low temperature in a series of heat exchangers (not shown) within the box 402. The heat exchanger arrangement in the cold box 402 may be the same as the arrangement of heat exchangers 50, 51, 52 and 53 shown in FIG. 3, or may be the same as the arrangement of heat exchangers 150, 151 and 153 shown in FIG. 6. The type of heat exchangers used depends on the pressure at which the natural gas is supplied. If the pressure is below about 5.5 MPa, then each heat exchanger comprises a number of aluminium plate heat exchangers manifolded in series. If the pressure is above about 5.5 MPa, then each heat exchanger comprises, for example, a spiral wound heat exchanger, a PCHE or a spool wound heat exchanger. However, when a spiral wound heat exchanger is used, the embodiment shown in FIG. 14 is more appropriate. The cold box 402 is filled with pearlite or rock wool to provide insulation.

The are many advantages to using a the cold box 402. First, it enables the majority of the cold equipment and piping to be contained within a single space that requires a much smaller plot area than if the equipment and piping were installed separately. The quantity of external insulation required is much less than if the equipment and piping were installed separately, and this reduces the cost and time of installation and future maintenance. In addition, the number of flanges required for connections of piping and equipment is reduced, because all the connections within the box are fully welded—this reduces the possibility of leaks from cold flange during normal operation and during cool-down and warm-up operations. The entire cold box installation can be constructed in a controlled industrial location and can be delivered to the construction site fully leak tested, dry and ready for commissioning—this would otherwise have to be done on the individual bits of equipment and piping in the field in remote locations and under less than ideal conditions. The cold box steel shell and insulation provides protection from the salt air environment in an offshore location, and affords a measure of fire protection for the equipment containing the hydrocarbon inventory. It should be noted that, when spiral wound heat exchangers are used, the first and intermediate exchanger bundles may both be included in a single vertical exchanger shell and may be installed separately to the cold box. In this case, the spiral wound heat exchanger is externally insulated and the cold box containing the remaining cold exchangers and vessel is significantly smaller.

The sub-cooled natural gas is withdrawn from the cold box 402, at its lowest temperature of about −158° C., into a conduit 452, through which it is fed to a liquid or hydraulic turbine expander disposed within a suction vessel 413 in which the sub-cooled natural gas is work expanded to a low pressure (which is sub-critical), with a concomitant reduction in temperature and the formation of LNG. The work generated in the liquid or hydraulic turbine expander in the suction vessel 413 is used to turn an electrical generator; the electrical generator is also housed within the suction vessel 413. It is possible for the liquid or hydraulic turbine expander and the suction vessel 413 to be replaced with a throttle valve: this will simplify the equipment, saving on capital costs and space, but there will be a small loss in process efficiency.

The LNG exits the liquid or hydraulic turbine expander in the suction vessel 413 into a conduit 453, which is fed back into the cold box 402 to a nitrogen stripper located within the cold box 402. The nitrogen stripper within the cold box 402 may be the same as the nitrogen stripper 57 in FIG. 3, or the nitrogen stripper 157 in FIG. 6. The cold flash gas from the top of the nitrogen stripper is then reheated in another heat exchanger in the cold box 402, which may be the same as the heat exchanger 55 shown in FIG. 3, or the heat exchanger 155 shown in FIG. 6. The reheated flash gash exits the cold box 402 into a conduit 454, which is equivalent to the conduit 10 of FIG. 3, or the conduit 110 of FIG. 6. The reheated flash gas in the conduit 454 is fed to a compressor unit 414 in which it is compressed to the required fuel gas system pressure. Cooling is provided in the compressor unit 414 by cooling water, which enters the unit 414 via conduit 455 and leaves the unit 414 via conduit 456. The compressed fuel gas exits the compressor unit 414 into a conduit 457. The compressor unit 414 may be an integrally geared multistage centrifugal compressor driven by an electric motor and complete with integral intercoolers and aftercoolers. Alternatively, the unit 414 may be an API specification centrifugal compressor with several compressor cases driven by an electric motor or a small gas turbine. The power requirements for the unit 414 may be provided by part of the fuel gas produced therein.

The LNG product exits the nitrogen stripper into a conduit 458, through which it is fed to a submerged pump 412. The submerged pump 412 pumps the LNG into a conduit 459, through which it is fed to storage tanks (see FIGS. 10 or 11).

The refrigeration of the natural gas in the cold box 402 is provided by a nitrogen refrigeration cycle, the components of which will now be described. Nitrogen refrigerant exits the cold box 402 into conduit 460, having been warmed to ambient temperatures by countercurrent heat exchange with the natural gas. The nitrogen in the conduit 460 is fed to a first stage compressor 405 where it is compressed to high pressure. The compressed nitrogen exits the compressor 405 into a conduit 461, through which it is fed to an intercooler 462, where the nitrogen is cooled with cooling water. The compressed nitrogen exits the intercooler 462 into a conduit 463 through which it is fed to a second stage compressor 406, where it is compressed to an even higher pressure. The compressed nitrogen exits the compressor 406 into a conduit 464, through which it is fed to an aftercooler 465, where the nitrogen is cooled with cooling water. The compressors 405 and 406 may be multi wheel API type compressors; alternatively, axial flow compressors may be used if the suction pressure is low enough and/or the circulation rate is high enough. The compressors 405 and 406 may be provided in the form of a single compressor.

The compressors 405 and 406 are driven by a gas turbine 403. The gas turbine 403 is an aero-derivative type of gas turbine because of its smaller size and weight compared to the alternative industrial type gas turbines commonly used in onshore LNG plants. The temperature of the ambient air locations where the plant is located is often high, and this can substantially reduce the site rating of gas turbine 403. This problem can be solved by cooling the gas turbine inlet air with chilled water in a heat exchanger 404. The turbine air is taken in through an inlet manifold 467 of the turbine 403, in which the heat exchanger 404 is disposed. The chilled water can be provided from the unit 15.

The high pressure nitrogen refrigerant exits the aftercooler 465 into a conduit 466, from which the flow is subsequently divided between conduits 470 and 471. The nitrogen flowing through the conduit 470 is fed to the compressor side of the expander/compressor unit 408, while the nitrogen flowing through the conduit 471 is fed to the compressor side of the expander/compressor unit 409. The compressed nitrogen exits the units 408 and 409 into conduits 472 and 473 respectively at an even higher, supercritical, pressure. The nitrogen flowing through the conduits 472 and 473 is recombined in a conduit 474, through which it is fed to an aftercooler 410, where it is cooled with cooling water. The nitrogen refrigerant exits the aftercooler 410 into a conduit 475, through which it is fed to a heat exchanger 411, where it is further cooled by countercurrent heat exchange with chilled water provided by the unit 15. The heat exchangers 462, 465, 410 and 411 are all stainless steel PCHE exchangers; a closed circuit of fresh water is used for cooling in exchangers 462, 465 and 410. Alternatively, direct seawater cooling may be used for these exchangers, if suitable materials of construction are employed.

The nitrogen refrigerant exits the heat exchanger 411 into a conduit 476, through which it is fed to the cold box 402, where it is pre-cooled in the series of heat exchangers in a similar manner to that shown in FIG. 3 or FIG. 6. A portion of the pre-cooled nitrogen (50–80 mol % of the total nitrogen flow) is withdrawn from the cold box 402 into a conduit 477, through which it is fed to the turbo expander end of the expander/compressor unit 409. The nitrogen in the expander compressor unit 409 is expanded to a lower pressure, with concomitant temperature drop. The work produced during this expansion stage is used to drive the compressor end of the expander/compressor unit 409. The expander nitrogen exits the turbo expander of the expander/compressor unit into a conduit 478.

Another portion of the pre-cooled nitrogen (20–50 mol % of the total nitrogen flow) is withdrawn from the cold box 402 into a conduit 479, through which it is fed to the turbo expander end of the expander/compressor unit 408; the nitrogen withdrawn into the conduit 479 has been cooled to a lower temperature than that withdrawn through the conduit 478. The nitrogen in the expander compressor unit 408 is expanded to a lower pressure, with concomitant temperature drop. The work produced during this expansion stage is used to drive the compressor end of the expander/compressor unit 408. The expanded nitrogen exits the turbo expander of the expander/compressor unit into a conduit 480.

The nitrogen in the conduits 478 and 480 is fed back to the series of heat exchanger within the cold box 402, and serves to cool the natural gas entering the cold box 402 via the conduit 451 and to pre-cool the nitrogen entering the cold box 402 via the conduit 476. The nitrogen flowing in the conduits 478 and 480 may follow the same path as the nitrogen in conduits 28 and 26 respectively in FIG. 3, or as the nitrogen in conduits 128 and 126 respectively in FIG. 6. As explained above, the warmed nitrogen is subsequently withdrawn from the cold box 402 via the conduit 460.

The expander/compressor units 408 and 409 may be conventional radial flow expander units. If desired the expander of expander/compressor unit 409 may be replaced by two expander units in parallel or in series. All the expander/compressor units 408/409 may be installed on a single skid to save on plot area and interconnecting pipework; they may also have a common lube oil skid, thereby saving further in plot area and cost. Another possibility is to connect the expanders to a single compressor or a multi-stage compressor, this would avoid the need to split the nitrogen flow into conduits 470 and 471.

The chilled water refrigeration unit 415 comprises one or more standard, commercially available units, which can use refrigerants such as Freon, propane, ammonia, etc. The chilled water is circulated to the heat exchangers 401, 404 and 411 in a closed circuit by centrifugal pumps (not shown). This unit has the advantage that it requires only a small inventory of refrigerant, and takes up very little space.

The cooling water system is also a closed circuit system—it uses fresh water to allow the use of PCHE exchangers. The PCHE heat exchangers have the advantage that they are considerably smaller and cheaper than the conventional shell and tube heat exchangers normally used for this type of system.

The nitrogen refrigeration system is a closed circuit system containing an initial inventory of dry nitrogen gas. This nitrogen must be replenished during normal operation, due to small losses of refrigerant from the circuit. These losses are caused by, for example, leaks to atmosphere from compressor seals and pipework flanges etc. A small amount of nitrogen is continuously added to the refrigeration system by nitrogen make-up unit (not shown), in order to compensate for the leakages. The nitrogen is extracted from the instrument air system on the plant. The make-up unit may be a commercially available unit, which can be of the membrane type or the pressure swing absorption type.

FIG. 14 shows another embodiment of the apparatus shown in FIG. 13. Many of the parts illustrated in FIG. 14 are identical to the parts illustrated in FIG. 13—like parts have been designated with like reference numerals. The differences are as follows:

The embodiment shown in FIG. 14 uses a series of heat exchangers in the form of a spiral wound heat exchanger (also known as a coil wound heat exchanger) 480 in place of the series of heat exchangers located within the cold box 402 in the apparatus shown in FIG. 13. The heat exchanger 480 is provided with its own thermal insulation, so there is no need to locate it within a cold box. Cooled natural gas at supercritical pressure is withdrawn from the heat exchanger 480 via a conduit 482, and is fed to a nitrogen stripper located within a cold box 484. The nitrogen stripper within the cold box 484 may be the same as the nitrogen stripper 57 or 157.

The five refrigeration cycles described above, and shown in FIGS. 4, 5, 7, 8 and 9, were simulated in order to make comparisons between the relative performance.

The first cycle, as illustrated in FIG. 4, used lean gas at a pressure of 5.5 MPa cooled with refrigerant at 1.2 MPa. The total power requirement was found to be 17.1 kW/tonne natural gas produced/day.

The second cycle, as illustrated in FIG. 5, used rich gas at a pressure of 5.5 MPa cooled with refrigerant at 1.2 MPa. The total power requirement was found to be 15.0 kW/tonne natural gas produced/day.

The third cycle, as illustrated in FIG. 7, used lean gas at a pressure of 5.5 MPa cooled with refrigerant at 1.7 MPa. The total power requirement was found to be 17.4 kW/tonne natural gas produced/day. However, although the power requirement was higher than the first and second cycle, the increased pressure allows the heat exchanger sizes to be reduced.

The fourth cycle, as illustrated in FIG. 8, used rich gas at a pressure of 7.6 MPa cooled with refrigerant at 2.4 MPa. The total power requirement was found to be 13.0 kW/tonne natural gas produced/day.

The fifth cycle, as illustrated in FIG. 9, used rich gas at a pressure of 8.25 MPa cooled with refrigerant at 1.8 MPa. The total power requirement was found to be 14.6 kW/tonne natural gas produced/day.

For comparison, the power requirement of a conventional propane pre-cooled mixed refrigerant cycle would be in the range 13 to 14 kW/tonne natural gas produced/day, and the power requirement of the simple nitrogen refrigeration cycle shown in FIG. 2 is about 27 kW/tonne natural gas produced/day. This shows that the process of the present invention is much more efficient than the simple refrigeration cycle.

Whilst certain embodiments of the invention have been described herein, it will be appreciated that the invention may be modified.

For the avoidance of doubt, the term "comprising" as used in this specification means "includes".

What is claimed is:

1. An offshore apparatus for liquefying natural gas, comprising:

a support structure which is either floatable or is otherwise adapted to be disposed in an offshore location at least partially above sea level, and natural gas liquefaction means disposed on or in the support structure, the natural gas liquefaction means comprising a series of heat exchangers for cooling the natural gas in countercurrent heat exchange relationship with a refrigerant, compression means for compressing the refrigerant, expansion means for isentropically expanding at least two separate streams of the compressed refrigerant, wherein said expanded streams of refrigerant communicate with a cool end of a respective one of the heat exchangers, a flash vessel for separating the natural gas cooled by said series of heat exchangers into a liquid phase stream and a gaseous phase stream, the gaseous phase stream being arranged in countercurrent head exchange relationship with part of the refrigerant by means, and wherein the flash vessel and at least some of the or each series of heat exchangers and pipework connected thereto are disposed within a single, common heat insulating housing.

2. The apparatus of claim 1, wherein:

the support structure is a fixed support structure.

3. The apparatus of claim 2, wherein:

the fixed support structure includes a steel jacket or a concrete gravity base.

4. The apparatus of claim 1, wherein:

the support structure is a floating support structure.

5. The apparatus of claim 4, wherein:

the support structure is a waterborne vessel having a steel or concrete hull.

6. The apparatus of claim 4, wherein:

the support structure is a floating production storage and off-loading unit.

7. The apparatus of claim 1, further comprising:

pretreatment means for pretreating the natural gas befor eit is delivered to the liquefaction means.

8. The apparatus of claim 1, further comprising:

storage means for storing liquefied natural gas produced by the liquefaction means.

9. The apparatus of claim 8, wherein:

the support structure comprises two spaced gravity bases, and a platform bridging said gravity bases, wherein said storage means comprises a storage tank provided on or in at least one of said gravity bases, and wherein the liquefaction means is provided on or in said bridging platform.

10. The apparatus of claim 1, further comprising:

means for connecting said apparatus to a subsea well, whereby the natural gas can be delivered to the liquefication means at a pressure above 5.5 Mpa, said pressure being derived directly or indirectly from the pressure in the subsea well.

11. A natural gas apparatus, for offshore installation, comprising:

natural gas liquefaction means comprising a series of heat exchangers for cooling the natural gas in countercurrent heat exchange relationship with a refrigerant, compression means for compressing the refrigerant, expansion means for isentropically expanding at least two separate streams of the compressed refrigerant, wherein said expanded streams fo refrigerant communicate with a cool end of a respective one of the heat exchangers into a liquid phase stream and a gaseous phase stream, the gaseous phase stream being arranged in countercurrent heat exchange relationship with part of the refrigerant by means, and wherein the flash vessel and at least some of the or each series of heat exchangers and pipework connected thereto are disposed within a single, common heat insulating housing; and a support frame carrying the components of the liquefaction means as a single unit for transportation to, and installation at, the offshore location.

12. The apparatus of claim 11, wherein:

the liquefaction means further comprises cooling means for cooling the refrigerant after it has been compressed and before it is isentropically expanded, said cooling means comprising a heat exchanger, a liquid coolant and a refrigerant unit for cooling the coolant to a temperature between −10° C. and 20° C., wherein the compressed refrigerant is cooled in said heat exchanger in countercurrent relationship with said coolant.

13. The apparatus of claim 1, wherein:

the expansion means comprises a work expander disposed in each of said compressed refrigerant streams, and the compression means comprising at least one compressor.

14. The apparatus of claim 1, wherein:

the series of heat exchangers comprises an initial heat exchanger, an intermediate heat exchanger and a final heat exchanger, and the natural gas is passed sequentially through the initial, the intermediate and the final heat exchangers in order to cool it to successively cooler temperatures, and wherein refrigerant in a first of said refrigerant streams is delivered to the final heat exchanger, and a refrigerant in a second of said refrigerant stream is delivered to the intermediate heat exchanger.

15. The apparatus of claim 14, wherein:

said refrigerant is cooled in the initial heat exchanger after being compressed, but before being isentropically expanded, and wherein the refrigerant in said first refrigerant stream is cooled in the intermediate heat exchanger after being cooled in the initial heat exchanger, but before being isentropically expanded.

16. The apparatus of claim 15, wherein the final heat exchanger receives refrigerant from the first refrigerant stream, the relative flowrates of the first and second refrigerant streams are such that the warming curve for the refrigerant comprises a plurality of segments of different gradient, the refrigerant is warmed in said final heat exchanger to a temperature below −80° C., and the coolest refrigerant temperature and the flowrate of refrigerant in said first refrigerant stream are such that a part of the refrigerant warming curve relating to the final heat exchanger is at all times with 1 to 10° C. of the corresponding part of the cooling curve for the natural gas.

17. The apparatus of claim 16, wherein:

coolest refrigerant temperature and the flowrate of refrigerant in said first refrigerant stream is such that the part of the refrigerant warming curve relating to the final heat exchanger is at all times within 1 to 5° C. of the corresponding part of the cooling curve for the natural gas.

18. The apparatus of claim 17, wherein:

the liquefaction means further comprises a gas turbine for generating power for the compression means.

19. The apparatus of claim 18, wherein:

the gas turbine comprises an aero-derivative gas turbine.

20. The apparatus of claim 19, wherein:

the liquefaction means further comprises a second series of heat exchangers, said second series of heat exchangers being arranged in parallel with said first series of heat exchangers, and a separate refrigerant compression means and refrigerant expansion means for each series of heat exchangers.

21. The apparatus of claim 20, wherein:

said series of heat exchangers comprises an aluminum plate heat exchanger, a spool wound heat exchanger, a spiral would heat exchanger, a printed circuit heat exchanger, or a combination of two or more thereof.

22. The apparatus of claim 21, wherein:

the refrigerant contains at least 50% vol. nitrogen.

23. The apparatus of claim 22, wherein:

the refrigerant contains substantially 100% vol. nitrogen.

* * * * *